US011732559B2

(12) United States Patent
Johnson et al.

(10) Patent No.: US 11,732,559 B2
(45) **Date of Patent: *Aug. 22, 2023**

(54) IN SITU INJECTION OR PRODUCTION VIA A WELL USING SELECTIVE OPERATION OF MULTI-VALVE ASSEMBLIES WITH CHOKED CONFIGURATIONS

(71) Applicant: NCS MULTISTAGE INC., Calgary (CA)

(72) Inventors: Timothy Johnson, Calgary (CA); Michael Werries, Calgary (CA); Lyle Laun, Calgary (CA)

(73) Assignee: NCS Multistage Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/583,155

(22) Filed: Jan. 24, 2022

(65) Prior Publication Data

US 2022/0145738 A1 May 12, 2022

Related U.S. Application Data

(63) Continuation of application No. 16/858,418, filed on Apr. 24, 2020, now Pat. No. 11,261,715.

(60) Provisional application No. 62/907,260, filed on Sep. 27, 2019.

(51) Int. Cl.

| | |
|---|---|
| ***E21B 43/14*** | (2006.01) |
| ***E21B 34/14*** | (2006.01) |
| ***E21B 43/16*** | (2006.01) |
| ***E21B 43/20*** | (2006.01) |

(52) U.S. Cl.

CPC ..... *E21B 43/14* (2013.01); *E21B 34/14* (2013.01); *E21B 43/162* (2013.01); *E21B 43/168* (2013.01); *E21B 43/20* (2013.01); *E21B 2200/02* (2020.05); *E21B 2200/06* (2020.05)

(58) Field of Classification Search

CPC ..... E21B 43/14; E21B 34/14; E21B 43/162; E21B 43/168; E21B 43/20; E21B 2200/02; E21B 2200/06

See application file for complete search history.

(56) References Cited

U.S. PATENT DOCUMENTS

| | | | | |
|---|---|---|---|---|
| 9,284,817 | B2 * | 3/2016 | Walton | E21B 34/06 |
| 9,816,348 | B2 * | 11/2017 | Asthana | E21B 34/06 |
| 10,767,456 | B2 * | 9/2020 | Konopczynski | E21B 34/06 |
| 2020/0217189 | A1 * | 7/2020 | Petrella | E21B 43/20 |
| 2020/0386073 | A1 * | 12/2020 | Joubran | E21B 47/06 |

* cited by examiner

*Primary Examiner* — Tara Schimpf
(74) *Attorney, Agent, or Firm* — Kimball Anderson; Jeffery M. Lillywhite

(57) ABSTRACT

Oil recovery can include providing a tubing string and isolation devices to define isolated intervals for an existing well previously operated using plug-and-perf and primary production. Valve assemblies are installed in respective isolated intervals, each valve assembly including at least two valves. The valve can be operated in open and closed configurations, and at least one open configuration provides choked flow via an elongated passage. The valves can have a housing and a shiftable sleeve. The valve assemblies can be operated to provide a desired openness based on the injectivity or other properties by shifting the sleeves of the valves. Different flow resistance levels can be provided to facilitate enhanced operations for water flooding and other oil recovery processes.

20 Claims, 22 Drawing Sheets

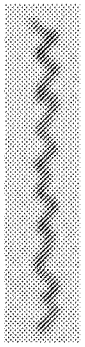
Fig. 22A
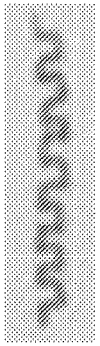
Fig. 22B
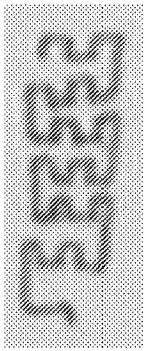
Fig. 22C
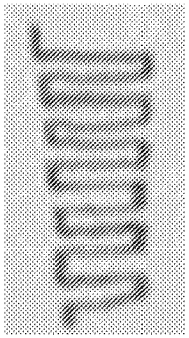
Fig. 22D
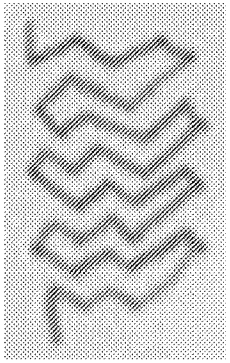
Fig. 22E
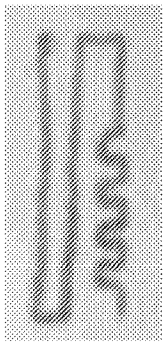
Fig. 22F
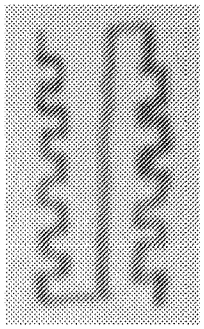
Fig. 22G
Fig. 23A
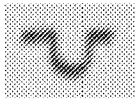
Fig. 23B
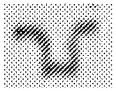
Fig. 23C
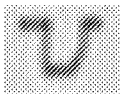
Fig. 23D
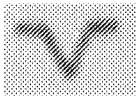
Fig. 23E
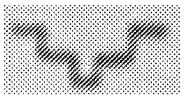
Fig. 23F

IN SITU INJECTION OR PRODUCTION VIA A WELL USING SELECTIVE OPERATION OF MULTI-VALVE ASSEMBLIES WITH CHOKED CONFIGURATIONS

CROSS-REFERENCE TO RELATED APPLICATIONS

This application claims priority to U.S. patent application Ser. No. 16/858,418, filed Apr. 24, 2020, entitled "IN SITU INJECTION OR PRODUCTION VIA A WELL USING SELECTIVE OPERATION OF MULTI-VALVE ASSEMBLIES WITH CHOKED CONFIGURATIONS", which claims priority to U.S. Provisional Application No. 62/907,260, filed Sep. 27, 2019, the entirety of which are both hereby incorporated by reference.

TECHNICAL FIELD

The technical field relates to apparatuses, systems and methods for producing hydrocarbon material from a subterranean formation.

BACKGROUND

Reservoirs are difficult to characterize and it would be useful to provide some flexibility within hardware used for injecting and producing fluids to optimize flow of material to and/or from the reservoir. Although electrically-actuatable tools are useful for effecting optimization, reliability of such tools may be compromised by loss of electrical communication with the surface. It can also be challenging to provide fluid flow into or out of different locations along a well in order to promote efficient hydrocarbon recovery operations.

SUMMARY

In one aspect, there is provided a flow control apparatus (valve assembly) for disposition within a wellbore of a subterranean formation, comprising: a housing; a fluid conducting passage defined within the housing; a housing flow communicator (housing port/outlet) configured for effecting flow communication between the fluid conducting passage and an environment external to the housing; a flow control member (valve sleeve) configured for controlling material flow between the fluid conducting passage and the environment external to the housing via the housing flow communicator (housing outlet); wherein: the flow control member defines a first flow modulator-defining flow communicator (first sleeve outlet) and a second flow modulator-defining flow communicator (second sleeve outlet); in a first operational configuration, the first flow modulator-defining flow communicator is aligned with the housing flow communicator; in a second operational configuration, the second flow modulator-defining flow communicator is aligned with the housing flow communicator; the housing flow communicator and the flow control member are co-operatively configured such that: while the flow control apparatus is disposed in the first operational configuration, flow communication is established between the fluid conducting passage and the environment external to the housing via the housing flow communicator; while the flow control apparatus is disposed in the second operational configuration, flow communication is established between the fluid conducting passage and the environment external to the housing via the housing flow communicator; and a change in disposition of the flow control apparatus between the first and second operational configurations is effectible in response to displacement of the flow control member, relative to the housing flow communicator.

In another aspect, there is provided a flow control apparatus for disposition within a wellbore of a subterranean formation, comprising: a housing; a fluid conducting passage defined within the housing; a housing flow communicator configured for effecting flow communication between the fluid conducting passage and an environment external to the housing; an uphole-disposed sealed interface effector that is actuatable to an actuated state for defining an uphole-disposed sealed interface; a downhole-disposed sealed interface that is actuatable to an actuated state for define a downhole-disposed sealed interface; a flow controller configured for controlling material flow between the fluid conducting passage and the environment external to the housing via the housing flow communicator; wherein: the flow controller defines a first flow modulator-defining flow communicator and a second flow modulator-defining flow communicator; in a first operational configuration, the first flow modulator-defining flow communicator is aligned with the housing flow communicator; in a second operational configuration, the second flow modulator-defining flow communicator is aligned with the housing flow communicator; the flow controller, the housing flow communicator, the uphole-disposed sealed interface effector, and the downhole-disposed sealed interface effector are co-operatively configured such that: while: (i) the flow control apparatus is disposed within the wellbore, (ii) the uphole-disposed sealed interface effector is disposed in the actuated state, and (iii) the downhole disposed sealed interface effector is disposed in the actuated state, a wellbore interval is established between the uphole-disposed sealed interface effector and the downhole-disposed sealed interface effector; while: (i) the wellbore interval is established, and (ii) the flow control apparatus is disposed in the first operational configuration, flow communication is established between the fluid conducting passage and the wellbore interval; and while: (i) the wellbore interval is established, and (ii) the flow control apparatus is disposed in the second operational configuration, flow communication is established between the fluid conducting passage and the wellbore interval.

In another aspect, there is provided a flow control apparatus for disposition within a wellbore of a subterranean formation, comprising: a housing; a fluid conducting passage defined within the housing; a housing flow communicator configured for effecting flow communication between the fluid conducting passage and an environment external to the housing; a flow controller configured for controlling material flow between the fluid conducting passage and the environment external to the housing via the housing flow communicator; an uphole-disposed sealed interface effector that is actuatable to an actuated state for defining an uphole-disposed sealed interface; a downhole-disposed sealed interface that is actuatable to an actuated state for define a downhole-disposed sealed interface; wherein: the flow controller defines a first flow modulator, a second flow modulator, and a third flow modulator; the first flow modulator defines a closure; the second flow modulator defines a second flow modulator-defining flow communicator; the third flow modulator defines a third flow modulator-defining flow communicator; the apparatus is configurable in at least a first operational configuration, a second operational configuration, a third operational configuration, and a fourth operational configuration; the first operational configuration corresponds to alignment between the first flow modulator and the housing flow communicator; the second operational configuration corresponds to alignment between the second flow modulator and the housing flow communicator; the third operational configuration corresponds to alignment between the closure and the housing flow communicator; the fourth operational configuration corresponds to alignment between the third flow modulator and the housing flow communicator; the flow controller, the housing flow communicator, the uphole-disposed sealed interface effector, and the downhole-disposed sealed interface effector are cooperatively configured such that: while: (i) the flow control apparatus is disposed within the wellbore, (ii) the uphole-disposed sealed interface effector is disposed in the actuated state, and (iii) the downhole disposed sealed interface effector is disposed in the actuated state, a wellbore interval is established between the uphole-disposed sealed interface effector and the downhole-disposed sealed interface effector; while: (i) the wellbore interval is established, and (ii) the flow control apparatus is disposed in the first operational configuration, there is an absence of flow communication, via the housing flow communicator, between the fluid conducting passage and the wellbore interval; while: (i) the wellbore interval is established, and (ii) the flow control apparatus is disposed in the second operational configuration, flow communication between the fluid conducting passage and the environment external to the housing, via the housing flow communicator, is effected via a second operational configuration-defined flow communicator having a second flow modulator-defining resistance to material flow, such that the fluid conducting passage is disposed in flow communication with the wellbore interval via the housing flow communicator; while: (i) the wellbore interval is established, and (ii) the flow control apparatus is disposed in the third operational configuration, there is an absence of flow communication, via the housing flow communicator, between the fluid conducting passage and the wellbore interval; while: (i) the wellbore interval is established, and (ii) the flow control apparatus is disposed in the fourth operational configuration, flow communication between the fluid conducting passage and the environment external to the housing, via the housing flow communicator, is effected via a fourth operational configuration-defined flow communicator having a third flow modulator-defining resistance to material flow, such that the fluid conducting passage is disposed in flow communication with the wellbore interval via the housing flow communicator; and the third flow modulator-defining resistance to material flow is greater than the second flow modulator-defining resistance to material flow by a multiple of at least 50.

In another aspect, there is provided a process for effecting material flow between the surface and a subterranean formation via a flow communication station, wherein the flow communication station includes a housing, a housing flow communicator, and a flow controller, wherein the flow communicator is disposed for communicating with the subterranean formation via a wellbore interval of the wellbore, and is disposed relative to one or more other flow communication stations such that there is an absence of flow communication, via the wellbore, with the one or more flow communication stations, wherein the flow controller is configured for controlling material flow between the surface and the subterranean formation and defines a first flow modulator-defining flow communicator and a second flow modulator-defining flow communicator, comprising: aligning the first flow modulator-defining flow communicator with the housing flow communicator with effect that flow communication is effected between the surface and the wellbore interval, via the housing flow communicator, such that the flow control apparatus becomes disposed in a first operational configuration; while the flow control apparatus is disposed in the first operational configuration, flowing material between the surface and the subterranean formation via the flow communicator; and effecting a change in the operational configuration of the flow control apparatus, with effect that the alignment between the first flow modulator-defining flow communicator and the housing flow communicator is defeated, and the second flow modulator-defining flow communicator becomes aligned with the housing flow communicator, such that the flow control apparatus becomes disposed in a second operational configuration.

In another aspect, there is provided a process of producing hydrocarbon material that is disposed within a subterranean formation, comprising: over a first time interval, producing at least a fraction of the hydrocarbon formation from the subterranean formation such that voidage within the subterranean formation is created; after the first time interval, emplacing a flow communication station downhole within a wellbore extending into the subterranean formation, wherein the flow communication station includes a housing, a housing flow communicator, and a flow controller, wherein the flow communicator is disposed for communicating with the subterranean formation via a wellbore interval of the wellbore, and is disposed relative to one or more other flow communication stations such that there is an absence of flow communication, via the wellbore, with the one or more flow communication stations, wherein the flow controller is configured for controlling material flow between the surface and the subterranean formation and defines a first flow modulator-defining flow communicator and a second flow modulator-defining flow communicator; after the emplacing of the flow communication station: aligning the first flow modulator-defining flow communicator with the housing flow communicator with effect that flow communication is effected between the surface and the wellbore interval, via the housing flow communicator, such that the flow control apparatus becomes disposed in a first operational configuration; while the flow control apparatus is disposed in the first operational configuration, flowing material between the surface and the subterranean formation via the flow communicator; effecting a change in the operational configuration of the flow control apparatus, with effect that the alignment between the first flow modulator-defining flow communicator and the housing flow communicator is defeated, and the second flow modulator-defining flow communicator becomes aligned with the housing flow communicator, such that the flow control apparatus becomes disposed in a second operational configuration; while the flow control apparatus is disposed in the second operational configuration, flowing material between the surface and the subterranean formation via the flow communicator; wherein: the flowing of material between the surface and the subterranean formation via the flow communicator, while the flow control apparatus is disposed in the first operational configuration, effects voidage replacement within the subterranean formation; and the flowing of material between the surface and the subterranean formation via the flow communicator, while the flow control apparatus is disposed in the second operational configuration, effects displacement of at least a fraction of the remaining hydrocarbon material from the subterranean formation.

In another aspect, there is provided a flow communication station configured for disposition within a wellbore of a subterranean formation, comprising: an electrically-actuatable flow control apparatus; a mechanically-actuatable flow control apparatus; an uphole-disposed sealed interface effector that is actuatable to an actuated state for defining an uphole-disposed sealed interface; a downhole-disposed sealed interface that is actuatable to an actuated state for define a downhole-disposed sealed interface; wherein: the electrically-actuatable flow control apparatus, the mechanically-actuatable flow control apparatus, the uphole-disposed sealed interface effector, and the downhole-disposed sealed interface effector are co-operatively configured such that: while: (i) the flow communication station is disposed within the wellbore, (ii) the uphole-disposed sealed interface effector is disposed in the actuated state, and (iii) the downhole disposed sealed interface effector is disposed in the actuated state, a wellbore interval is established between the uphole-disposed sealed interface effector and the downhole-disposed sealed interface effector; and while the wellbore interval is established, each one of the electrically-actuatable flow control apparatus and the mechanically-actuatable flow control apparatus, independently, is disposed for effecting flow communication between the surface and the wellbore interval.

In another aspect, there is provided a process for effecting material flow between the surface and a subterranean formation via a flow communication station, wherein the flow communication station includes an electrically-actuatable flow control apparatus configured for effecting flow communication between the surface and the subterranean formation, and also includes a mechanically-actuatable flow control apparatus configured for effecting flow communication between the surface and the subterranean formation, comprising: determining that the electrically-actuatable flow control apparatus is ineffective for effecting flow communication between the surface and the subterranean formation; and mechanically actuating the mechanically-actuatable flow control apparatus, with effect that the flow communication is effected between the surface and the subterranean formation.

In yet another aspect, there is provided a method for enhanced oil recovery using an existing horizontal well section of a wellbore that has been fractured and operated for primary production. The method includes the steps of: running a tubing string into the horizontal well to define an annulus between the tubing string and the wellbore, and defining a plurality of wellbore intervals isolated from one another along the horizontal well defined by isolation devices deployed in spaced-apart relation to each other within the annulus; for one or more of the wellbore intervals, installing a valve assembly along the tubing string, the valve assembly comprising at least a first valve and a second valve to define a multivalve interval, each of the first and second valves being operable in a corresponding open configuration for allowing fluid flow from the tubing string into the surrounding reservoir via a corresponding fluid passage and a closed configuration for preventing fluid flow into the surrounding reservoir, the fluid passage of at least one of the first and second valves being elongated and configured such that the open configuration of the corresponding valve is a choked configuration where fluid flowrate from the tubing string into the reservoir is restricted; in at least one of the multivalve intervals, operating the first valve in the open configuration and the second valve in the closed configuration; injecting a fluid down the tubing string so as to pass through the first valve in the open configuration to measure an injectivity of the corresponding wellbore interval or surrounding reservoir; based on the measured injectivity, selectively operating each of the first valve and the second valves in the open or closed configuration; and injecting a fluid down the tubing string so as to pass through at least one of the first valve and second valve to drive oil toward a production well.

According to an implementation, each valve of the multivalve interval comprises a corresponding valve housing provided with a valve sleeve slidably mounted therein, and wherein each valve sleeve is operable in a central position, an uphole position and a downhole position, the position of the valve sleeves within their respective valve housings corresponding to an operational configuration of the respective valves.

According to an implementation, each valve sleeve is initially in the central position when the first and second valves are installed along the tubing string.

According to an implementation, the central position of each valve sleeve corresponds to the closed configuration of the corresponding valve, and wherein at least one of the uphole and downhole positions of at least one valve sleeve corresponds to the open configuration of the corresponding valve.

According to an implementation, the uphole position of the valve sleeve of the first valve corresponds to a first open configuration of the first valve, and wherein the downhole position of the valve sleeve of the first valve corresponds to a second open configuration of the first valve.

According to an implementation, the first and second open configurations of the first valve are configured such that the fluid flowrate between the tubing string and the reservoir when in one of the first and second open configurations is greater than the fluid flowrate between the tubing string and the reservoir when in the other one of the first and second open configurations.

According to an implementation, the first and second open configurations are provided by respective elongated fluid passages each defined by a channel in an outer surface of the sleeve of the first valve and an inner surface of the housing that overlays the channel.

According to an implementation, the elongated fluid passages of the first and second open configurations have different cross-sectional areas or different lengths or a combination thereof, to provide different resistance to fluid flow.

According to an implementation, the elongated fluid passages of the first and second open configurations are sized and configured to provide different resistances to fluid flow by a multiple of 1.25 to 5 times.

According to an implementation, the first and second valves are preconfigured to provide redundancy where at least two different configurations of the valve assembly provides a substantially similar overall openness for fluid flow through the fluid passages.

According to an implementation, the first and second valves are preconfigured to provide higher precision of fluid flow adjustment at lower flowrates compared to higher flowrates.

According to an implementation, the first and second valves are preconfigured to provide a range of overall openness for fluid flow through the fluid passages at the different configurations of the valve assembly, the range comprising evenly distributed flow resistances from minimum to maximum fluid flow.

According to an implementation, at least one of the first and second vales comprises an open configuration for injecting fluid via a fully open aperture for high throughput.

According to an implementation, the fluid flowrate between the tubing string and the reservoir when in the first or second open configuration is substantially the same.

According to an implementation, the fluid flowrate between the tubing string and the reservoir is defined by at least one of a shape and size of the fluid passage of each valve in the open configuration.

According to an implementation, the valve assembly comprises a plurality of valves each having corresponding elongated fluid passages defining respective fluid flowrates between the tubing string and the reservoir when the valves are in the open configuration, and wherein each valve is independently operable between the open and closed configurations, thereby defining a predetermined range of fluid flowrates between the tubing string and the reservoir.

According to an implementation, the injectivity is characterized by a shut-off threshold, and wherein, when the measured injectivity is below the shut-off threshold, the first valve and the second valve are both operated in the closed configuration.

According to an implementation, when the measured injectivity is above the shut-off threshold, the first valve is operated in the open configuration, and the second valve is operated in the open configuration.

According to an implementation, the open configuration of one of the first and second valves is the choked configuration for restricting fluid flowrate into the reservoir, and wherein the open configuration of the other one of the first and second valves is a high throughput configuration.

According to an implementation, multiple wellbore intervals comprise respective valve assemblies that are operated to provide fluid injection based on the respective measured injectivities.

According to an implementation, when one of the wellbore intervals experiences a rise in injectivity above a given threshold indicating fluid bypass or thief zone, both of the valves of the valve assembly installed along the corresponding wellbore interval are displaced to the closed configuration to cease injection via the corresponding valve assembly.

According to an implementation, when one of the wellbore intervals has a rise in injectivity, at least one of the first and second valves installed along the corresponding wellbore interval is displaced to a more restricted configuration to reduce the flowrate into the corresponding interval.

According to an implementation, the valve assemblies of adjacent wellbore intervals are operated in a manner to cooperate with one another when fluid communication is established between the adjacent wellbore intervals.

According to an implementation, fluid communication between adjacent valves along the same wellbore interval is established along the annulus, in the surrounding reservoir, or a combination thereof.

According to an implementation, fluid communication between adjacent wellbore intervals is established along the annulus, in the surrounding reservoir, or a combination thereof According to an implementation, the horizontal well has been fractured via plug-and-perf.

According to another aspect, there is provided a method for oil recovery including the steps of: running a tubing string into an existing well previously operated for primary production, to define an annulus between the tubing string and a wellbore, and defining a plurality of wellbore intervals isolated from one another along the well defined by isolation devices deployed in spaced-apart relation to each other within the annulus; for multiple wellbore intervals, installing a corresponding valve assembly along the tubing string, the valve assembly comprising at least a first valve and a second valve to define a multivalve interval, each valve being operable in at least one of an open configuration for establishing fluid communication between the tubing string and the surrounding reservoir via respective fluid passages and a closed configuration for preventing fluid flow into the surrounding reservoir, the fluid passage of at least one of the first and second valves being elongated and configured such that the open configuration of the corresponding valve is a choked configuration where fluid flowrate from the tubing string into the reservoir is restricted; determining at least one operational parameter comprising at least one property of an injection fluid, or at least one characteristic of the wellbore intervals, or a combination thereof; based on the at least one determined operational parameter, for each wellbore interval selectively operating the first valve and the second valve in the open or closed configuration to provide an selected openness for each valve assembly in the corresponding wellbore interval; injecting at least one injection fluid down the tubing string so as to pass through at least one of the first valve and second valve to enter the reservoir at corresponding wellbore intervals and promote recovery of oil via at least one adjacent production well.

According to an implementation, a single injection fluid is injected over time or different injection fluids are alternated over time.

According to an implementation, the injection fluid is water and the method is operated as a water flooding operation.

According to an implementation, the well is horizontal or vertical.

According to an implementation, the method further includes, after injecting the injection fluid for a period of time, adjusting the configuration of at least one of the valve assemblies in a corresponding wellbore interval to change the selected openness thereof based on a change in the determined operational parameter.

According to an implementation, the change in the determined operational parameter comprises an increase in injectivity, and the change to the selected openness comprises reducing the openness to increase the resistance to flow via the valve assembly.

According to an implementation, the change in the determined operational parameter comprises modifying a type or a property of the injection fluid.

According to an implementation, the first and second valves of the multivalve interval each comprise a corresponding valve housing provided with a valve sleeve slidably mounted therein and being shiftable to different positions to provide the open and closed configurations.

According to an implementation, each valve sleeve is operable in a central position, an uphole position and a downhole position, the position of the valve sleeves within their respective valve housings corresponding to an operational configuration of the corresponding valve.

According to an implementation, the change of the selected openness of each valve assembly is performed by shifting the sleeve of at least one of the first and second valves.

According to an implementation, each valve sleeve is initially in the central position when the first and second valves are installed along the tubing string.

According to yet another aspect, there is provided a method for oil recovery in an existing well, the method comprising: running a tubing string into the well to define an annulus between the tubing string and the wellbore, and defining a plurality of wellbore intervals isolated from one another along the well defined by isolation devices deployed in spaced-apart relation to each other within the annulus; for multiple wellbore intervals, installing a valve assembly along the tubing string, the valve assembly comprising a first valve and a second valve to define a multivalve interval, each valve being operable in at least one of an open configuration for establishing fluid communication between the tubing string and the surrounding reservoir via respective fluid passages and a closed configuration for preventing fluid flow from the surrounding reservoir through the valve, the fluid passage of at least one of the first and second valves being elongated and configured such that the open configuration of the corresponding valve is a choked configuration where fluid flowrate the reservoir into the tubing string is restricted; determining at least one operational parameter comprising at least one property of a production fluid, or at least one characteristic of the wellbore intervals, or a combination thereof; based on the at least one determined operational parameter, for each wellbore interval selectively operating the first valve and the second valve in the open or closed configuration to provide a selected openness for each valve assembly in the corresponding wellbore interval; recovering production fluid components that pass through at least one of the first valve and second valve to enter the tubing string from the surrounding reservoir at corresponding wellbore intervals, to form a combined production fluid within the tubing string; and producing the combined production fluid to surface via the tubing string.

BRIEF DESCRIPTION OF DRAWINGS

The embodiments will now be described with reference to the following accompanying drawings, in which:

FIGS. 22A to 22G are schematic views of examples of a tortuous fluid passage for limiting fluid flow between a valve and a surrounding reservoir.

FIGS. 23A to 23F are schematic views are schematic views of examples of cross-sections of a fluid passage establishing fluid communication between a valve and a surrounding reservoir.

DETAILED DESCRIPTION

Figure 1:
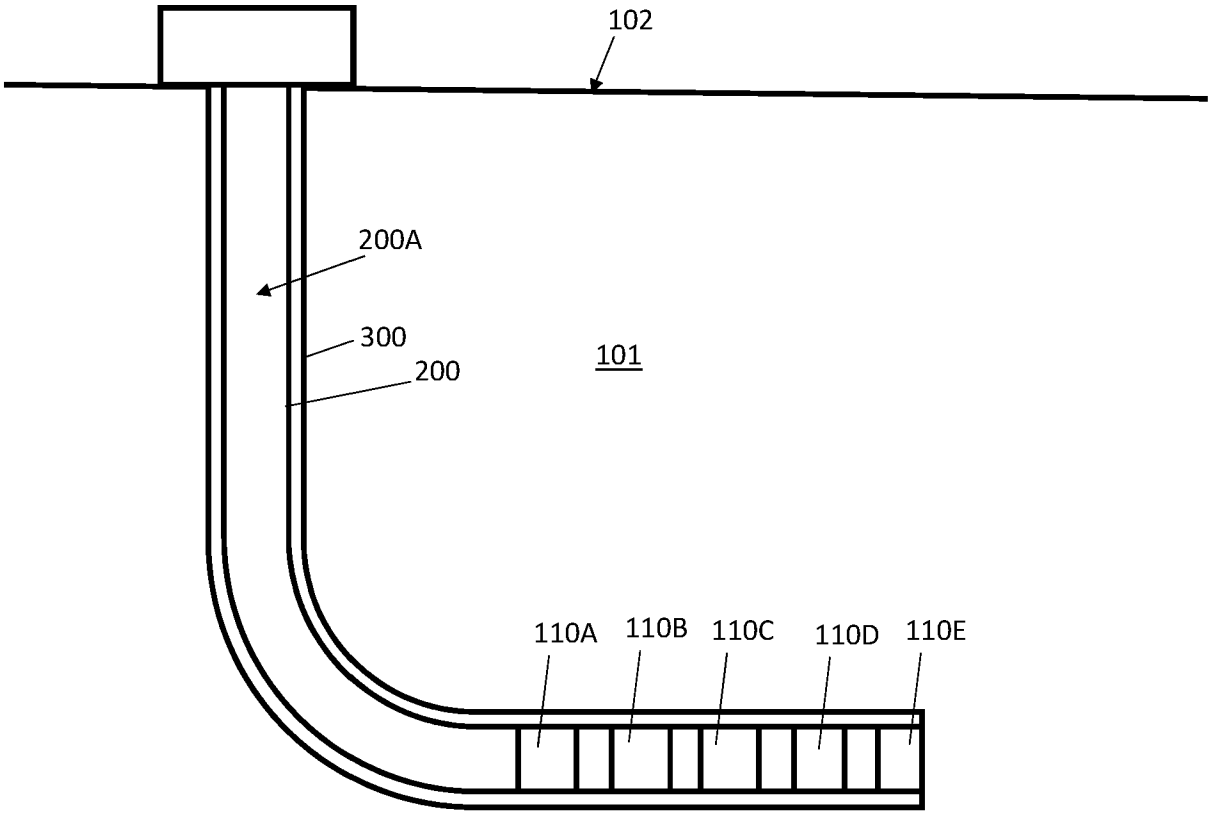
FIG. 1 is a schematic illustration of an embodiment of a downhole system of the present disclosure, which includes a plurality of flow communication stations.
Figure 2A:
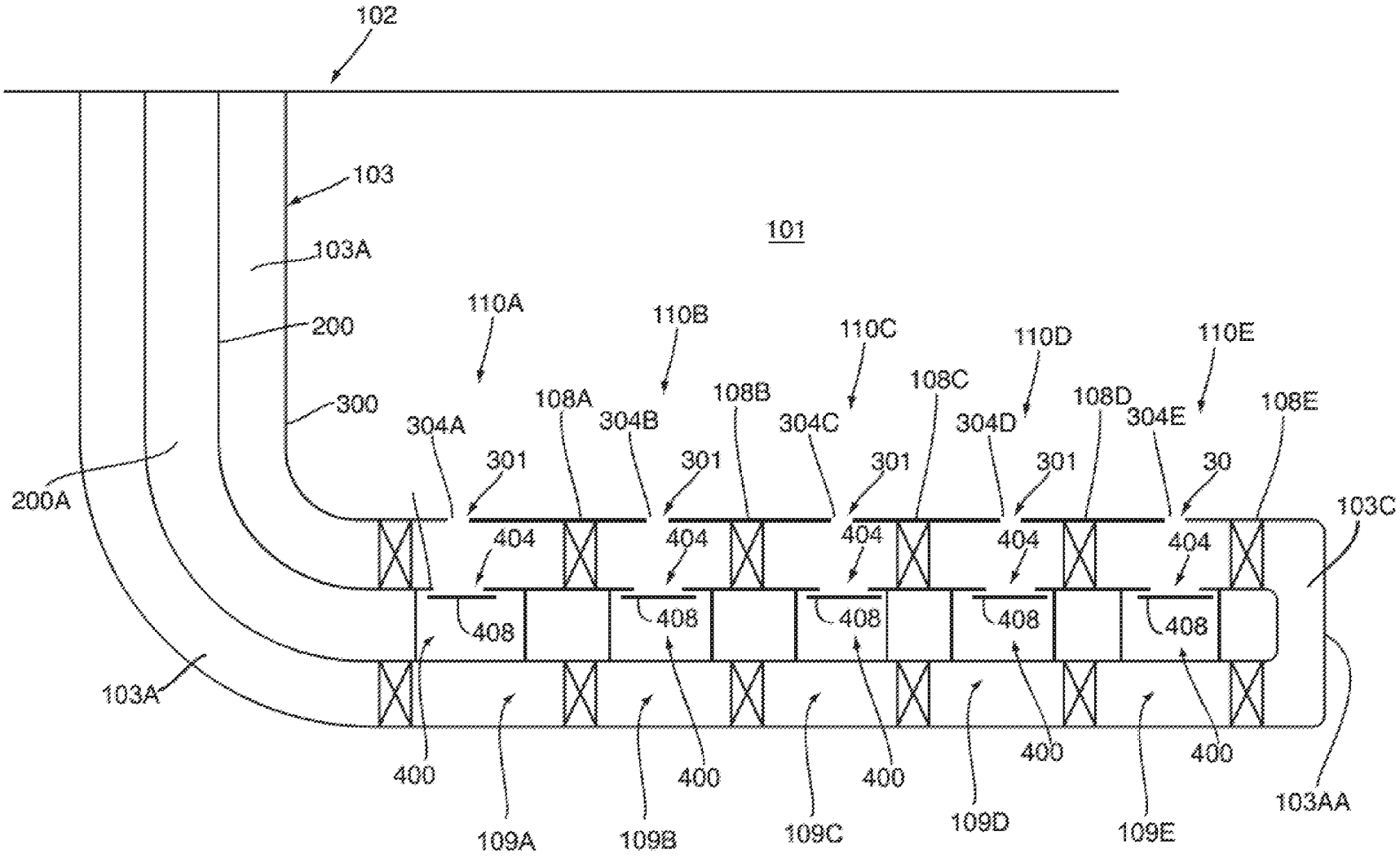
FIG. 2A is a schematic illustration of another embodiment of a downhole system of the present disclosure, which includes a plurality of flow communication stations, each one of the flow communication stations includes a mechanically-actuatable flow control apparatus, and the downhole system is disposed within a cased-hole completion.
Figure 2B:
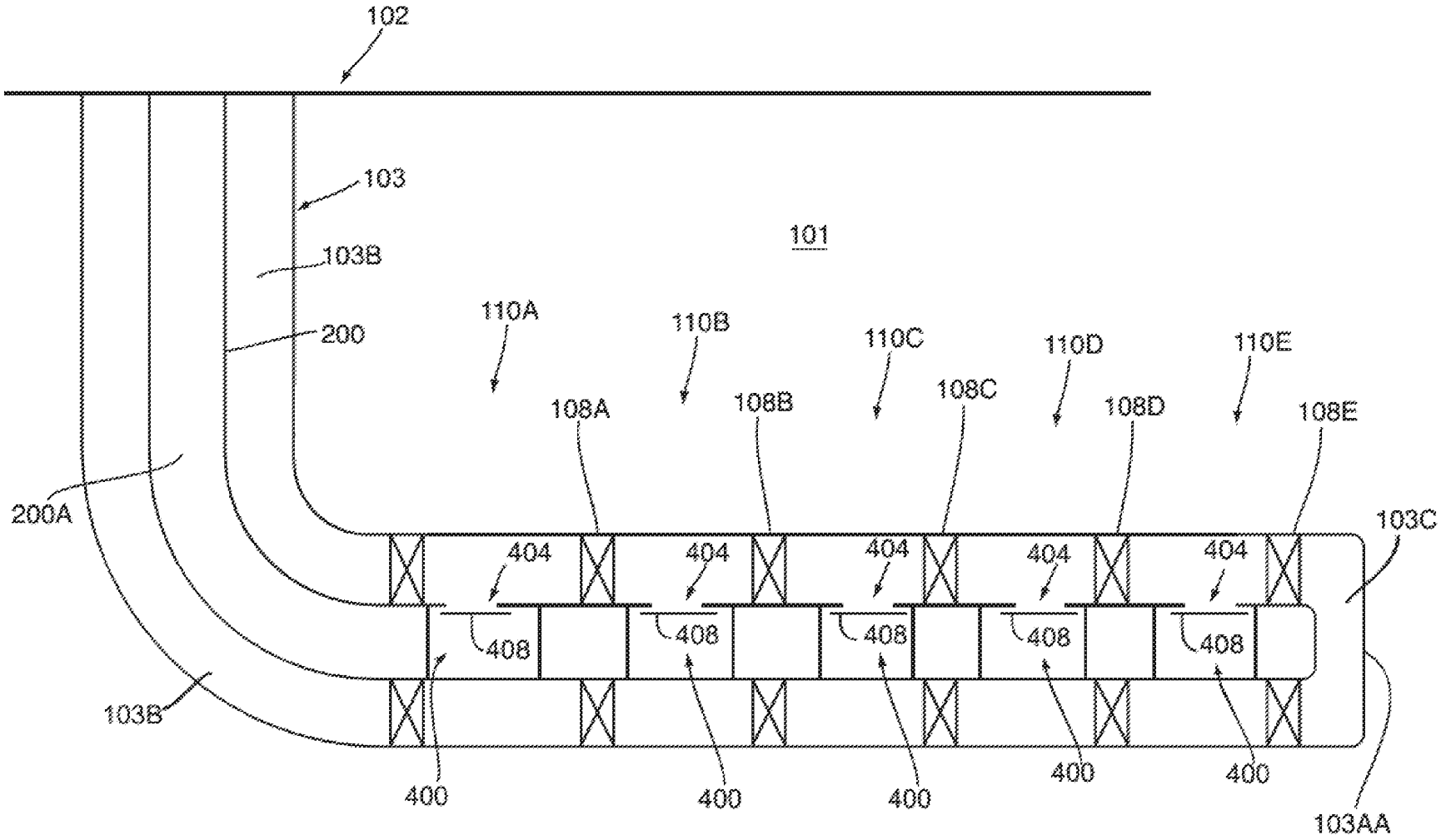
FIG. 2B is a schematic illustration of another embodiment of a downhole system of the present disclosure, which includes a plurality of flow communication stations, each one of the flow communication stations includes a mechanically-actuatable flow control apparatus, and the downhole system is disposed within an open hole completion.
Figure 3:
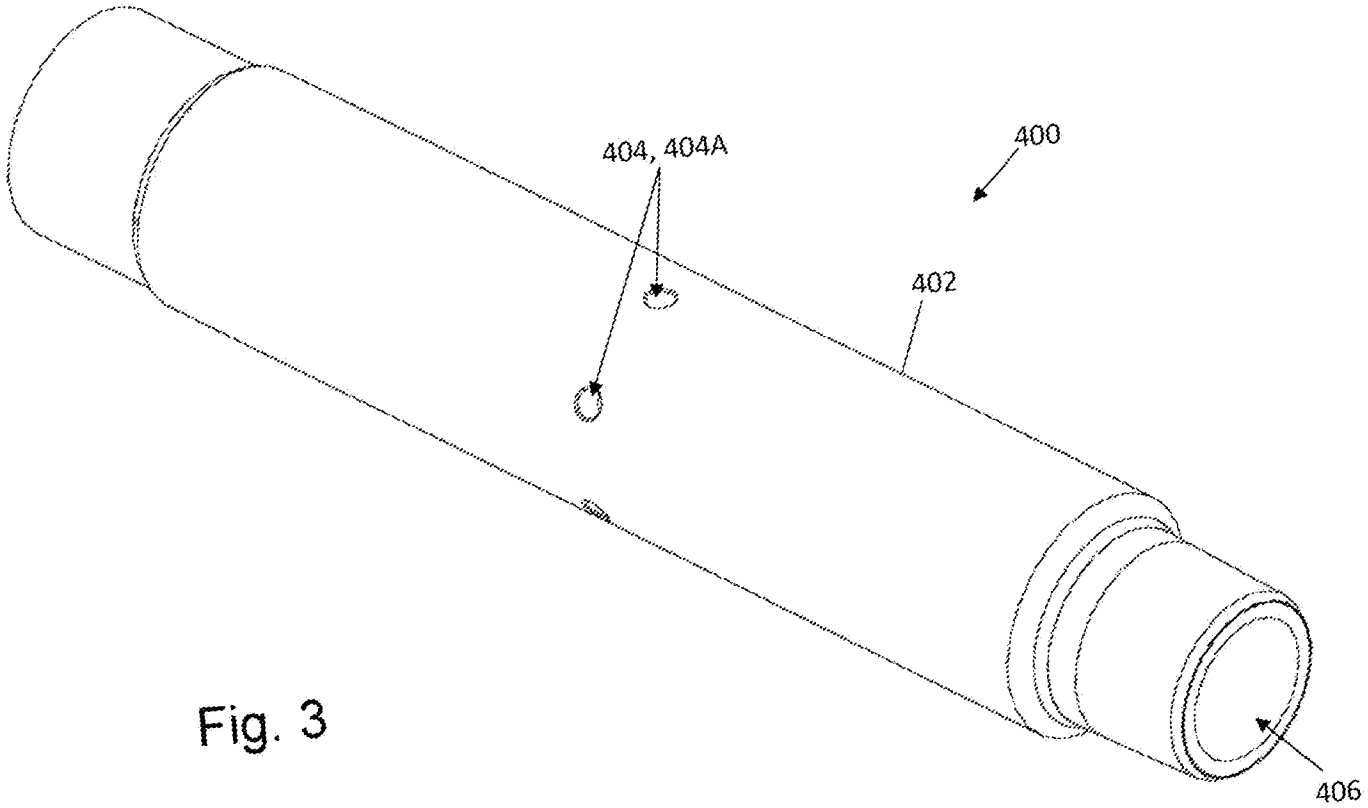
FIG. 3 is a perspective view of a first embodiment of a flow control apparatus.

Referring to FIGS. 1 to 3, this relates to a mechanically-actuatable flow control apparatus (which can also be referred to as a valve assembly) 400 for downhole deployment within a wellbore 103 that extends from the surface 102 and into a subterranean formation 101. The flow control apparatus 400 is intended for integration within a wellbore string 200 that is emplaced within the wellbore 103. The integration may be effected, for example, by way of threading or welding, although other configurations are possible.

Amongst other things, the flow control apparatus (valve assembly) 400 is configured for effecting/establishing flow communication between the surface 102 and the subterranean formation 101. The flow control apparatus 400 is useable for conducting all forms of fluid, such as, for example, liquids, gases, or mixtures of liquids and gases. In some embodiments, for example, the flow control apparatus 400 is useable for effecting injection of fluid. In some embodiments, for example, the injecting of the fluid into the subterranean formation 101 is for stimulating hydrocarbon production via a displacement process (such as, for example, waterflooding) or via a cyclic process (such as "huff and puff"). In some embodiments, for example, the injected fluid is a liquid material, a gaseous material, or a mixture of a liquid material and a gaseous material. In this respect, in some embodiments, for example, the flow control apparatus (valve assembly) 400 is configured for emplacement within a wellbore 103 that functions as an injection well. In other embodiments, for example, the flow control apparatus is useable for effecting production of hydrocarbon material from the subterranean formation 101, such as production that is stimulated via a displacement process. In this respect, in some embodiments, for example, the flow control apparatus is configured for emplacement within a wellbore 103 that functions as a production well.

Figure 1A:
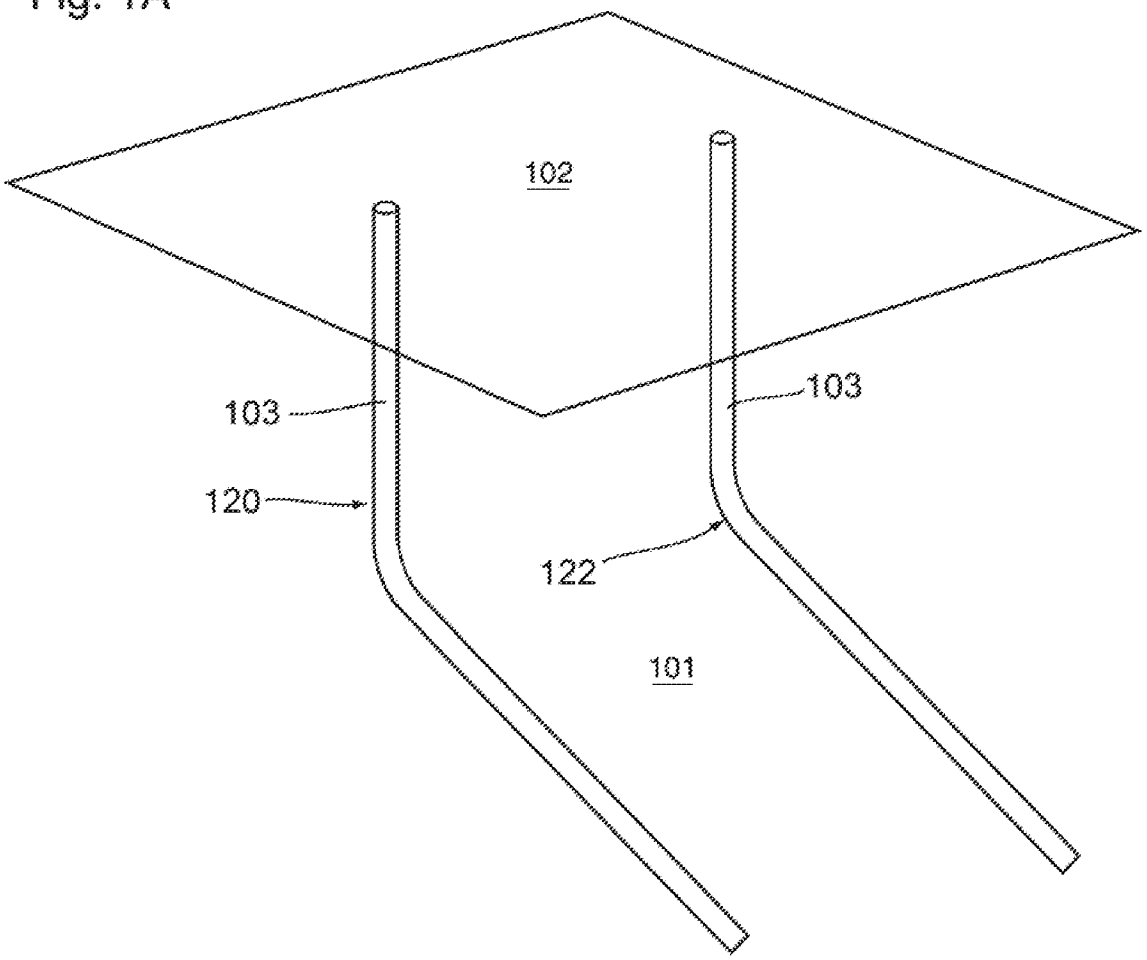
FIG. 1A is a schematic illustration a system for effectuating hydrocarbon production.

A well system 100, including an injection well 120 and a production well 122, extending from the surface 102 and into a subterranean formation 101, is illustrated in FIG. 1A. In some embodiments, for example, hydrocarbon production, via a displacement process, may be effectuated via the well system 100, and, in this respect, to effectuate the displacement process, fluid material (e.g. water) is injected via the injection well 120, resulting in displacement of hydrocarbon material from the subterranean formation 101 and into the production well 120, and flow of the displaced hydrocarbon material to the surface 102 via the production well 120.

In some embodiments, for example, the mechanically-actuatable flow control apparatus (valve assembly) 400 is co-operatively configured with an electrically-actuatable flow control apparatus (electrical valve assembly), such that the mechanically-actuatable flow control apparatus 400 functions as a back-up in the event that the electrically-actuatable flow control apparatus becomes non-operational.

The wellbore 103 can be straight, curved, or branched and can have various wellbore sections. A wellbore section is an axial length of a wellbore. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

The wellbore string 200 defines a wellbore string passage 200A for conducting fluid between the surface 102 and the subterranean formation 101. Flow communication between the wellbore string 200 and the subterranean formation 101 is effected at predetermined locations along the wellbore string 200, described herein as flow communication stations. In the present embodiment, five (5) flow communication stations 110A-E are illustrated, although it is appreciated that other configurations are possible. Successive flow communication stations may be spaced from each other along the wellbore such that each one of the flow communication stations 110A-E, independently, is positioned adjacent a zone or interval of the subterranean formation 101 for effecting flow communication between the wellbore string 200 and the zone (or interval).

For effecting/establishing the flow communication between the wellbore string 200 and the subterranean formation 101, the one or more of the flow communication stations 110A-E can include a mechanically-actuatable flow control apparatus (valve assembly) 400.

Referring to FIGS. 4 to 12, in addition to FIG. 3, the flow control apparatus (valve assembly) 400 includes a housing 402. A fluid conducting passage 406 is defined within the housing 402 for effecting conduction of fluid through the flow control apparatus 400 while the flow control apparatus 400 is integrated within the wellbore string 200. In this respect, the fluid conducting passage 406 forms part of the wellbore string passage 200A.

The housing 402 also defines a housing flow communicator (which can also be referred to as a housing outlet) 404 through which the flow communication, between the passage 406 and an environment external to the housing 402, is effectible. In some embodiments, for example, the housing flow communicator 404 can include one or more ports 404A defined within the outermost surface of the housing 402.

The mechanically-actuatable flow control apparatus (valve assembly) 400 is configurable in a plurality of operational configurations, and each one of the operational configurations, independently, corresponds to a state of flow communication, via the housing flow communicator (housing outlet) 404, between the fluid conducting passage 406 and an environment external to the housing 402. Modulation/Adjustment of the flow of material, via the flow communicator 404, between the passage 406 and an environment external to the housing 402 is effectible in response to a change in the operational configuration of the flow control apparatus (valve assembly) 400 (e.g. a change from a first operational configuration to a second operational configuration).

The mechanically-actuatable flow control apparatus (valve assembly) 400 also includes a flow controller 408. The flow controller 408 is configured for determining the state of flow communication, via the housing flow communicator 404, between the fluid conducting passage 406 and an environment external to the housing 402.

For effecting the determining of the state of flow communication, the flow controller 408 defines/includes one or more flow modulators, and each one of the one or more flow modulators, independently, is configured for alignment with the flow communicator (housing outlet) 404 for determining a respective state of flow communication. It should be understood that, as used herein, the expression "flow modulator" can refer to a portion, member, device or feature of the flow controller 408 adapted to adjust the flowrate of fluids flowing through the flow communicator 404 (e.g., between the fluid conducting passage 406 and the environment external to the housing 402).

Referring to FIGS. 1 and 2A, in some embodiments, for example, the wellbore 103 is completed as a cased-hole completion. In such embodiments, the wellbore 103 is lined with casing 300.

A cased-hole completion involves running casing 300 down into the wellbore 103 through the production zone. The casing 300 at least contributes to the stabilization of the subterranean formation 101 after the wellbore 103 has been completed, by at least contributing to the prevention of the collapse of the subterranean formation 101 that is defining the wellbore 101. In some embodiments, for example, the casing 300 includes one or more successively deployed concentric casing strings, each one of which is positioned within the wellbore 103, having one end extending from the wellhead. In this respect, the casing strings are typically run back up to the surface. In some embodiments, for example, each casing string includes a plurality of jointed segments of pipe. The jointed segments of pipe typically have threaded connections.

In some embodiments where the wellbore 103 is completed as a cased completion, the casing includes a plurality of casing flow communicators 304A-E, and for each one of the flow communication stations 110A-E, independently, the flow communication between the wellbore 103 and the subterranean formation 101 is effected through the respective one of the casing flow communicators 304A-E. In some embodiments, for example, each one of the casing flow communicators 304A-E, independently, is defined by one or more openings 301. In some embodiments, for example, the openings are defined by one or more ports that are disposed within a sub that has been integrated within the casing string 300, and are pre-existing. In other words, the ports exists before the sub, along with the casing string 300, has been installed downhole within the wellbore 103. Referring to FIG. 2A, in some embodiments, for example, the openings are defined by perforations 301 within the casing string 300, and the perforations are created after the casing string 300 has been installed within the wellbore 103, such as by a perforating gun. In some embodiments, for example, for each one of the flow communication stations 110A-E, independently, the respective one of the casing flow communicator (casing outlet) 304A-E is disposed in alignment, or substantial alignment, with the housing flow communicator (housing outlet) 404 of the respective one of the flow communication stations 110A-E.

In some embodiments, for example, it is desirable to seal an annulus, formed within the wellbore, between the casing string 300 and the subterranean formation 101. With respect to injection wells, sealing of the annulus is desirable for mitigating versus conduction of the fluid, being injected into the subterranean formation, into remote zones of the subterranean formation and thereby providing greater assurance that the injected fluid is directed to the intended zone of the subterranean formation. To prevent, or at least interfere, with conduction of the injected fluid through the annulus, and, perhaps, to an unintended zone of the subterranean formation that is desired to be isolated from the formation fluid, or, perhaps, to the surface, the annulus is filled with a zonal isolation material. In some embodiments, for example, the zonal isolation material includes cement, and, in such cases, during installation of the assembly within the wellbore, the casing string is cemented to the subterranean formation 101, and the resulting system is referred to as a cemented completion.

In some embodiments, for example, the zonal isolation material is disposed as a sheath within an annular region between the casing 300 and the subterranean formation 101. In some embodiments, for example, the zonal isolation material is bonded to both of the casing 300 and the subterranean formation 101. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 300, and (d) at least contributes to the support of the casing 300.

In this respect, in those embodiments where the wellbore 103 is completed as a cased completion, in some of these embodiments, for example, for each one of the flow communication stations 110A-E, independently, flow communication, is effectible/established between the surface 102 and the subterranean formation 101 via the wellbore string 200, the respective housing flow communicator (housing outlet) 404, an annular space 103A within the wellbore 103 (e.g., between the wellbore string 200 and the casing string 300), and the corresponding one of the casing string flow communicators (casing outlets) 304A-E.

Referring to FIG. 2B, in some embodiments, for example, the wellbore 103 is completed as an open hole completion. In this respect, in those embodiments where the wellbore 103 is an open hole completion, for each one of the flow communication stations 110A-E, independently, flow communication is effectible/established between the surface 102 and the subterranean formation 101 via the wellbore string 200, the respective housing flow communicator (housing outlet) 404, and an annular space 103B within the wellbore 103 (e.g., between the wellbore string 200 and the subterranean formation 101).

In some embodiments, for example, for each one of the adjacent flow communication stations, independently, a sealed interface is disposed within the wellbore 103 for preventing, or substantially preventing, flow communication, via the wellbore 103, between adjacent flow communication stations. In this respect, with respect to the embodiments illustrated in FIGS. 2A and 2B, sealed interfaces 108A-D are provided. In some embodiments, for example, with respect to the flow communication station that is disposed furthest downhole (i.e. flow communication station 110E), sealed interface 108E is disposed within the wellbore 103 for preventing, or substantially preventing, flow communication between the flow communication station 110E and a downhole-disposed portion 103C of the wellbore 103. The sealed interfaces 108A-E define a plurality of wellbore intervals 109A-E.

In some embodiments, for example, the sealed interface 108 is established by actuation of an actuatable sealed interface effector. The actuatable sealed interface effector is actuatable to an actuated state to defined a sealed interface. In some embodiments, for example, the actuatable sealed interface effector is a packer. In those embodiments where the completion is a cased completion (FIG. 2A), the sealed interface can extend across the annular space 103A (e.g., between the wellbore string 200 and the casing string 300). In those embodiments where the completion is an open hole completion (FIG. 2B), the sealed interface can extend across the annular space 103B between the wellbore string 200 and the subterranean formation 101.

Figure 4:
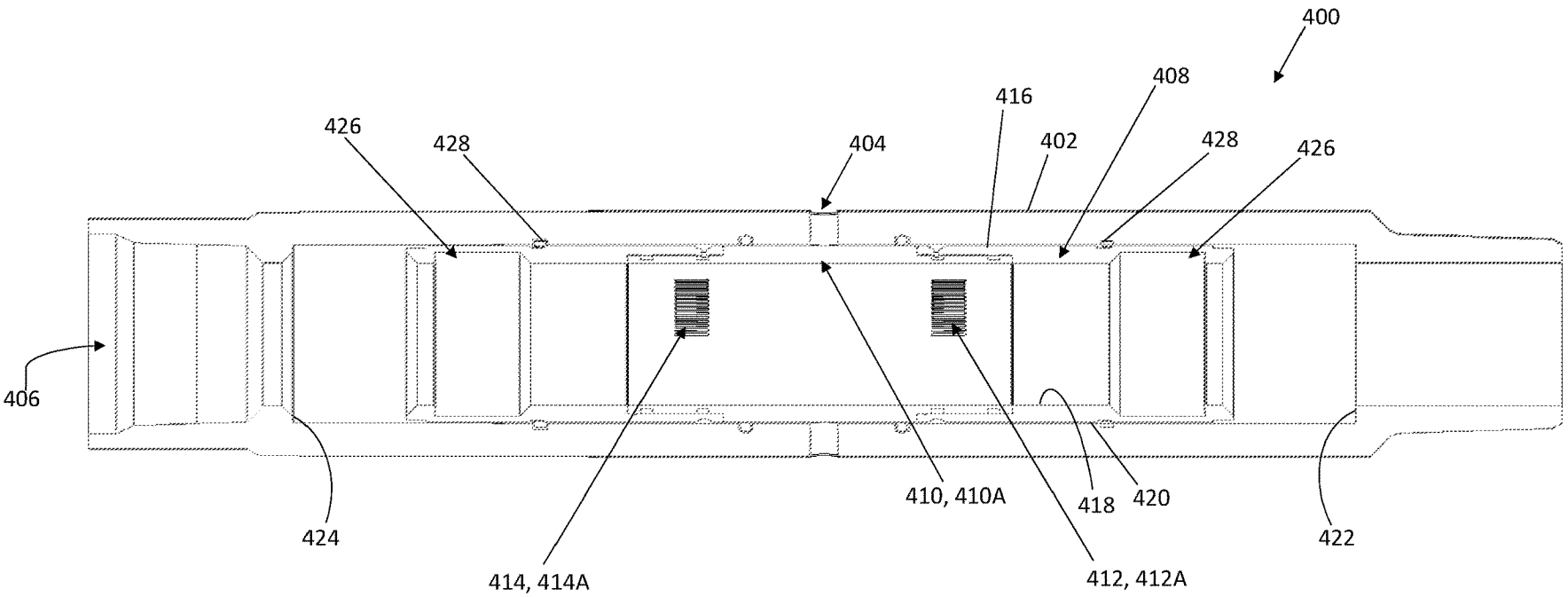
FIGS. 4 to 6 are sectional views of the first embodiment of a flow control apparatus shown in FIG. 3, illustrated in a first configuration (FIG. 4), a second configuration (FIG. 5), and a third configuration (FIG. 6)
Figure 5:
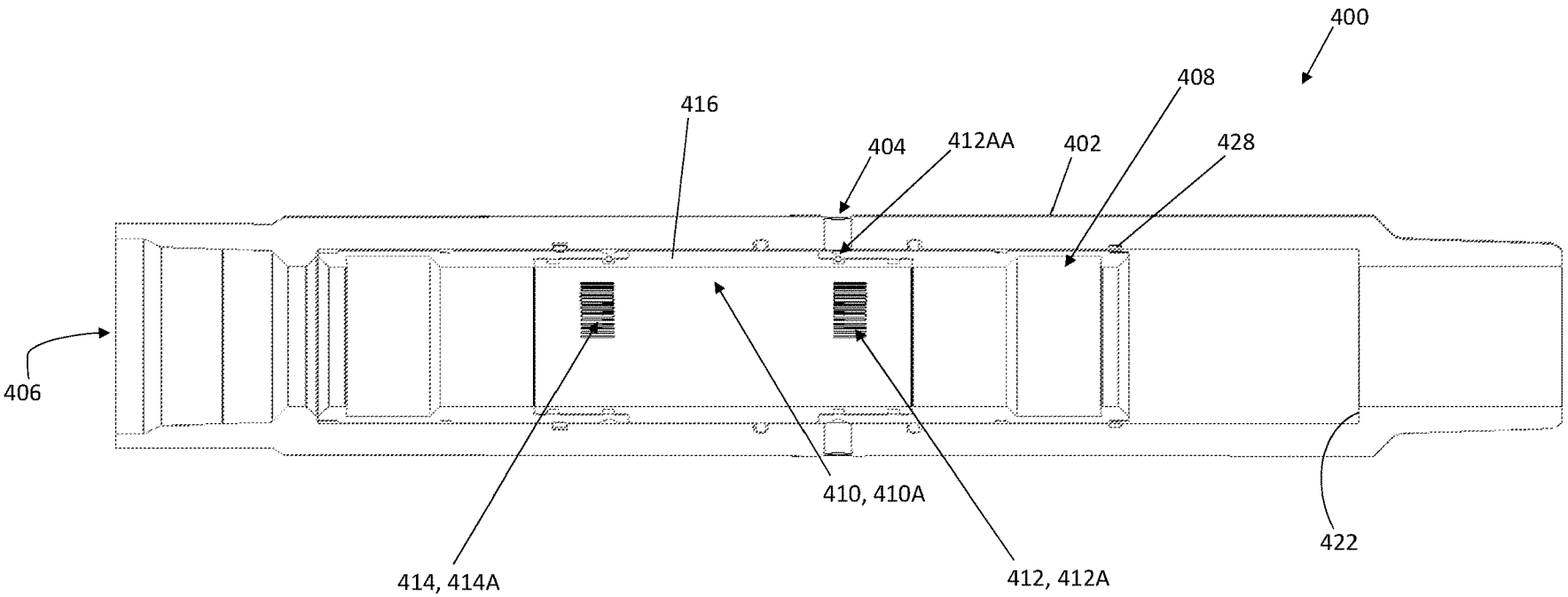
Figure 6:
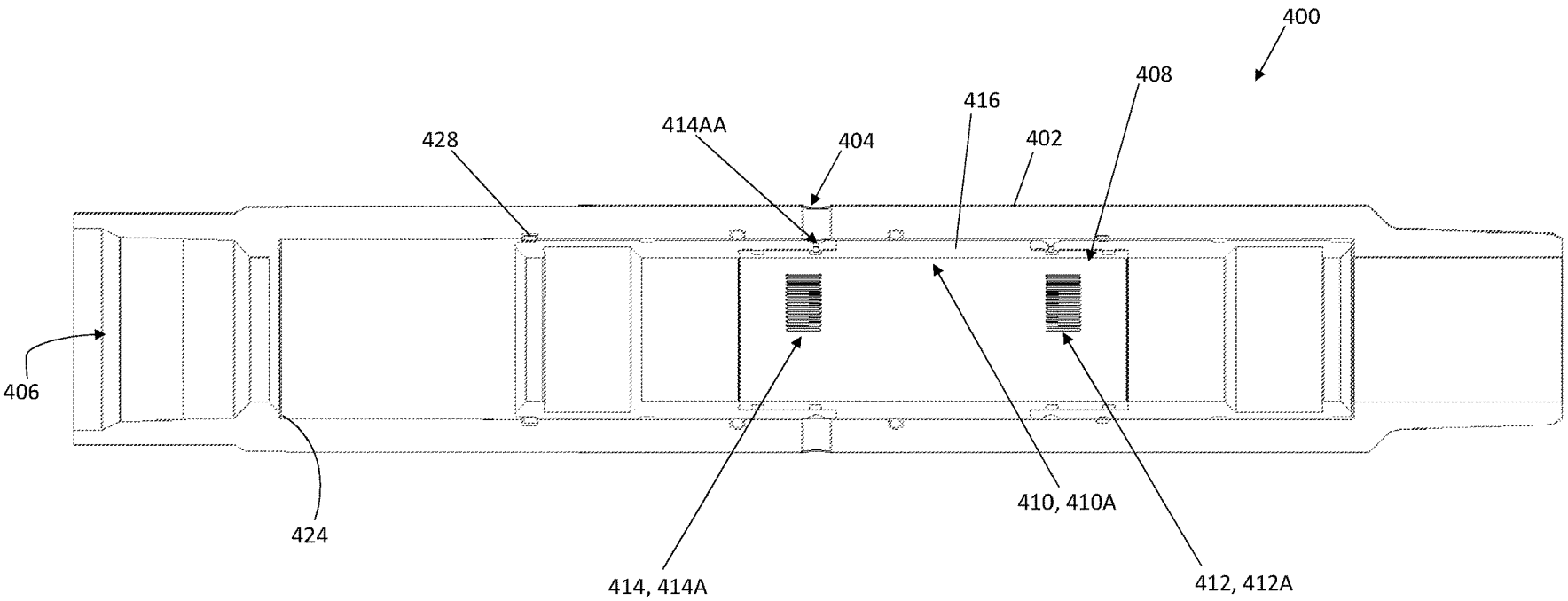

Referring to FIGS. 4 to 6, in a first embodiment of the apparatus (valve assembly) 400, for example, the apparatus 400 is configurable in at least a first operational configuration (FIG. 4), a second operational configuration (FIG. 5), and a third operational configuration (FIG. 6). The first operational configuration defines a closed configuration, and the second and third operational configurations define first and second choked configurations, respectively. In this embodiment, the flow controller 408 can include a first flow modulator 410, a second flow modulator 412, and a third flow modulator 414. In some embodiments, each one of the operational configurations, independently, corresponds to an alignment between corresponding flow modulators (of the flow controller 408) and the housing flow communicator (housing outlet) 404. More specifically, the first operational configuration (i.e., the closed configuration) corresponds to an alignment between the first flow modulator 410 and the housing flow communicator (housing outlet) 404. The second operational configuration corresponds to alignment between the second flow modulator 412 and the housing flow communicator 404. The third operational configuration corresponds to alignment between the third flow modulator 414 and the housing flow communicator 404.

The first flow modulator 410 is defined by a closure element 410A configured for effecting closure of the housing flow communicator (housing outlet) 404. In some embodiments, the housing 402 and the flow controller 408 can be cooperatively configured such that, while the alignment between the first flow modulator 410 and the housing flow communicator 404 is established, the housing flow communicator 404 is disposed in the closed condition (i.e., is at least partially occluded/blocked). In this respect, while the alignment between the first flow modulator 410 and the housing flow communicator 404 is established, there is an absence of flow communication, via the flow communicator (housing outlet) 404, between the fluid conducting passage 406 and the subterranean formation. In some of these embodiments, for example, the first flow modulator 410 functions to occlude the housing flow communicator 404. In some embodiments, the first flow modulator 410 is defined by an uninterrupted solid surface, such as the outer surface of a portion of the flow controller 408, for example. As seen in FIGS. 4 to 6, the first flow modulator 410 can be a central flow modulator 410, positioned between the second and third flow modulators 412, 414. In this embodiment, the second flow modulator 412 is positioned downhole of the first flow modulator 410, and the third flow modulator 414 is uphole of the first flow modulator 410, although it is appreciated that other configurations are possible.

The second flow modulator, or downhole flow modulator 412, can include a second flow modulator-defining flow communicator (also referred to as a downhole sleeve outlet) 412A, and the third flow modulator, or uphole flow modulator 414, can include a third flow modulator-defining flow communicator (also referred to as an uphole sleeve outlet) 414A. The housing 402 and the flow controller 408 can be cooperatively configured such that, while the second flow modulator-defining flow communicator (downhole sleeve outlet) 412A is aligned with the housing flow communicator (housing outlet) 404, flow communication between the fluid conducting passage 406 and the environment external to the housing is effected/established via a first operational configuration-defined flow communicator (via a first fluid pathway defined by the alignment of the downhole sleeve outlet 412A and housing outlet 404) having a first flow modulator-defining resistance to material flow. Similarly, while the third flow modulator-defining flow communicator (uphole sleeve outlet) 414A is aligned with the housing flow communicator (housing outlet) 404, flow communication between the fluid conducting passage 406 and the environment external to the housing 402 is effected/established via a second operational configuration-defined flow communicator (via a second fluid pathway defined by the alignment of the uphole sleeve outlet 414A and housing outlet 404) having a second flow modulator-defining resistance to material flow.

It should be noted that the flow modulators as described herein have downhole and/or uphole outlets which can include one or more ports defined within the outermost surface of the flow controller 408, or related components, as will be described below. For example, the downhole sleeve outlet 412A of the second flow modulator 412 can include as many ports as the housing outlet 404 has ports. Therefore, it is appreciated that each port of the downhole sleeve outlet 412A aligns with a corresponding port of the housing outlet 404, although other configurations are possible. For example, a fluid flow path can be defined between the downhole and/or uphole sleeve outlet 412A, 414A and the ports of the housing outlet 404, with the flow controller being provided with a single port for establishing fluid communication between the fluid conducting passage 406 and the fluid flow path, as will be described further below.

With respect to the communicators (downhole and uphole sleeve outlets) 412A, 414A, in some embodiments, for example, each one of the communicators 412, 414A, independently, is in the form of a passage. The second flow modulator-defining resistance to material flow can be greater than the first flow modulator-defining resistance to material flow. In other words, the flowrate of fluids flowing along the first fluid pathway can be greater than the flowrate of fluids flowing along the second fluid pathway. In some of these embodiments, for example, the second flow modulator-defining resistance to material flow is greater than the first flow modulator-defining resistance to material flow by a multiple of at least 1.25, such as, for example, at least 1.5, such as, for example, at least two (2), such as, for example at least five (5). In some of these embodiments, for example, the minimum cross-sectional flow area of the second flow modulator-defining flow communicator (downhole sleeve outlet) 412A is greater than the minimum cross-sectional flow area of the third flow modulator-defining flow communicator (uphole sleeve outlet) 414A. In some of these embodiments, for example, the second flow modulator-defining flow communicator (downhole sleeve outlet) 412A includes a tortuous flow path-defining fluid passage (e.g., the first fluid pathway) 412AA that defines a tortuous flow path, and the third flow modulator-defining flow communicator (uphole sleeve outlet) 414A includes a tortuous flow path-defining fluid passage (the second fluid pathway) 414AA that defines a tortuous flow path.

In those embodiments where the first operational configuration defines a closed configuration, and the second and third operational configurations define first and second choked configurations, respectively, in some of these embodiments, for example, a process for effecting/establishing material flow between the surface 102 and the subterranean formation 101 is provided, and the process includes:

emplacing the flow control apparatus (valve assembly) 400 in the first operational configuration, i.e., the closed configuration (FIG. 4);

effecting a change in the operational configuration of the flow control apparatus 400, with effect that the operational configuration of the flow control apparatus 400 changes from the first operational configuration to one of the second and third operational configurations, i.e., the first and second choked configurations (FIGS. 5 and 6); and while the flow control apparatus 400 is disposed in the one of the second and third operational configurations, effecting material flow between the surface 102 and the subterranean formation 101.

In some embodiments, for example, the process further includes:

after effecting material flow between the surface 102 and the subterranean formation 101 while the flow control apparatus 400 is disposed in the one of the second and third operational configurations, effecting a change in the operational configuration of the flow control apparatus 400, with effect that the operational configuration of the flow control apparatus 400 changes from the one of the second and third operational configurations to the other one of the second and third operational configurations; and while the flow control apparatus 400 is disposed in the other one of the second and third operational configuration, effecting material flow between the surface 102 and the subterranean formation 101.

In some embodiments, for example, the change in the operational configuration of the flow control apparatus (valve assembly) 400, with effect that the operational configuration of the flow control apparatus 400 changes from the one of the second and third operational configurations to the other one of the second and third operational configurations, is effected in response to detection of a condition that is representative of the efficiency of the material flow being effected between the surface 102 and the subterranean formation 101 while the flow control apparatus 400 is disposed in the one of the second and third operational configurations. In some embodiments, for example, the change is effected in response to pressure of fluid material that is detected within the wellbore. In some embodiments, for example, the change is effected in response to a determination that the flow rate of material at the flow communication station does not achieve one or more performance objectives. For example, and as mentioned above, the second fluid pathway offers a resistance to fluid flow up to five (5) times greater than the resistance to fluid flow of the first fluid pathway, therefore, if pressure builds up within the valve assembly 400 when in the third operational configuration, the valve assembly can be configurable in the second operational configuration (via adjustment of the flow controller 408 within the housing) to allow fluid to flow along the first fluid pathway, which offers less resistance, and thus increases flowrate, when compared to the second fluid pathway.

In some of these embodiments, for example, the material flow between the surface 102 and the subterranean formation 101 is a material flow from the surface 102 to the subterranean formation 101, such that the material flow includes material being injected into the subterranean formation 101, and such that the process includes stimulation of hydrocarbon production from the subterranean formation 101. In other ones of these embodiments, for example, the material flow between the surface 102 and the subterranean formation 101 is a material flow from the subterranean formation 101 to the surface 102, such that the material flow includes material being produced from the subterranean formation 101, and such that the process includes hydrocarbon production from the subterranean formation 101.

In those embodiments where the process includes stimulation of hydrocarbon production from the subterranean formation 101, in some of these embodiments, for example, the material flow, which is effected while the flow control apparatus (valve assembly) 400 is disposed in the second operational configuration, is for injecting material, at a first flowrate, into the subterranean formation 101, for displacing hydrocarbon material from the subterranean formation 101 to the surface 102, and the material flow, which is effected while the flow control apparatus 400 is disposed in the third operational configuration, is for injecting material, at a second flowrate, into the subterranean formation 101, for displacing hydrocarbon material from the subterranean formation 101 to the surface 102, and the first flowrate is greater than the second flowrate since the resistance to fluid flow along the second fluid pathway can be up to five (5) times greater than the resistance to fluid flow along the first fluid pathway.

Figure 7:
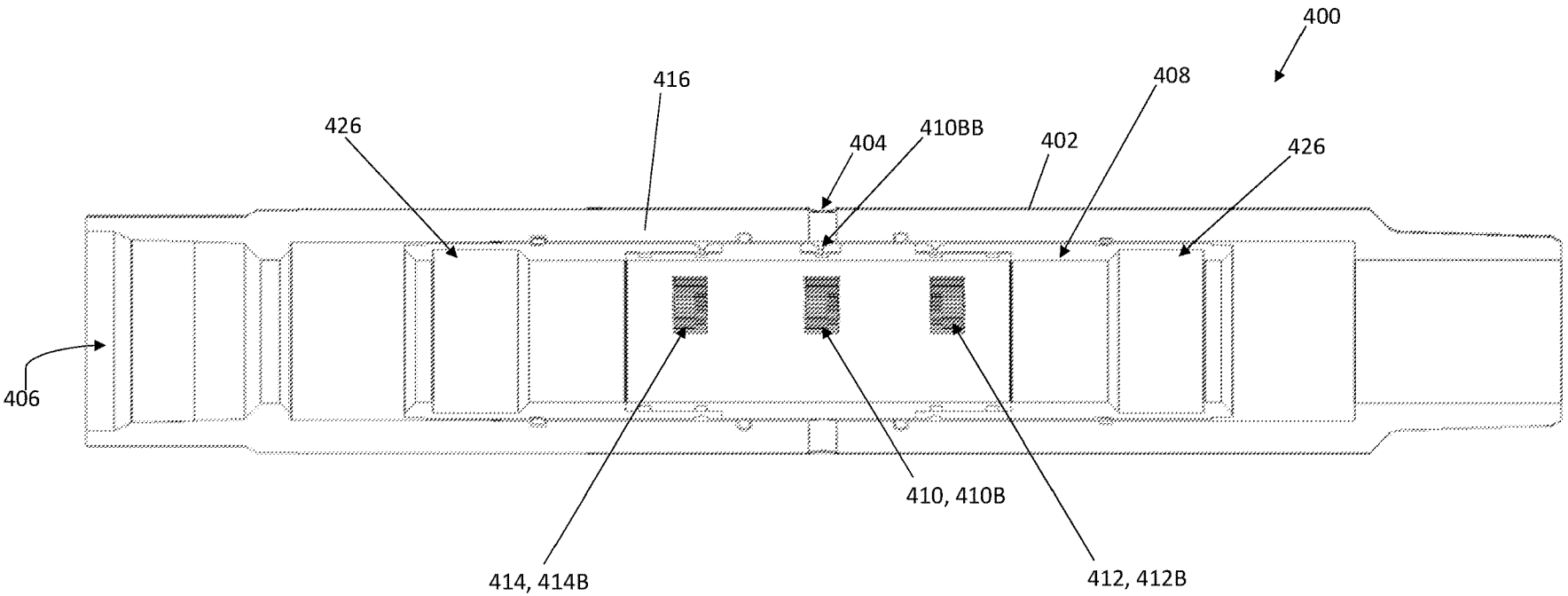
FIGS. 7 to 9 are sectional views of a second embodiment of a flow control apparatus, illustrated in a first configuration (FIG. 7), a second configuration (FIG. 8), and a third configuration (FIG. 9)
Figure 8:
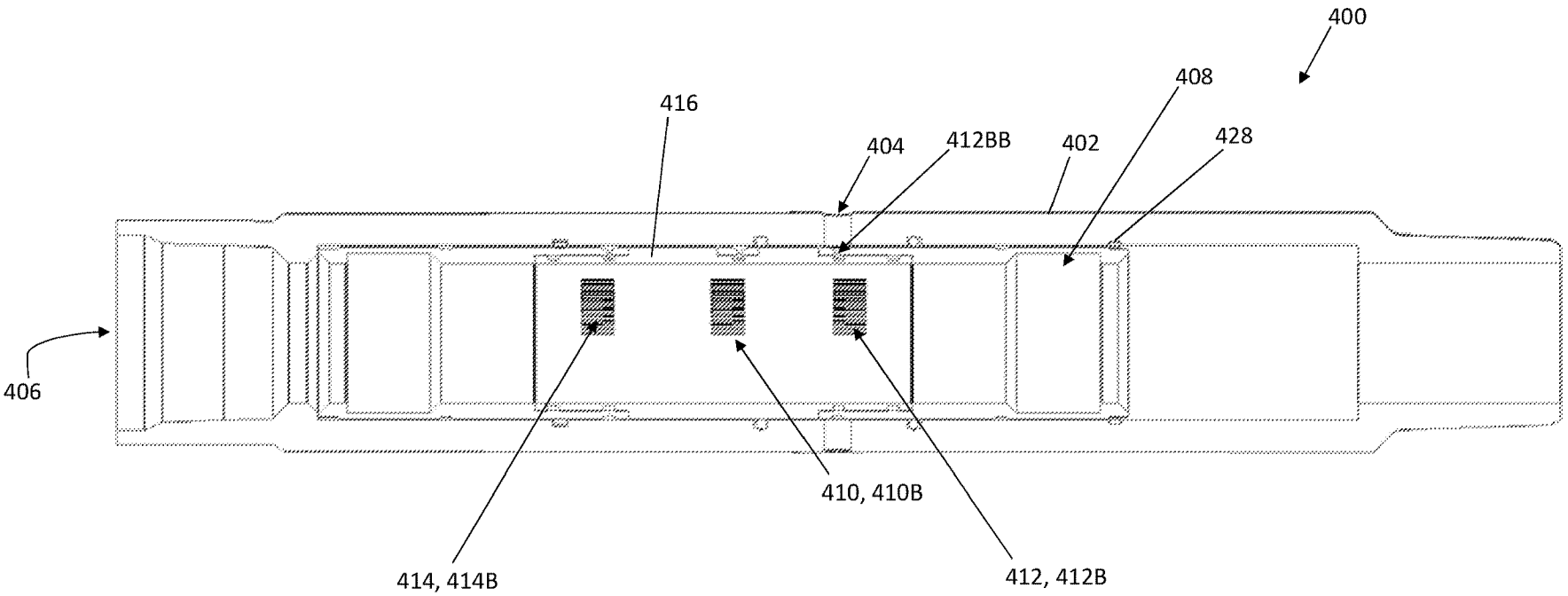
Figure 9:
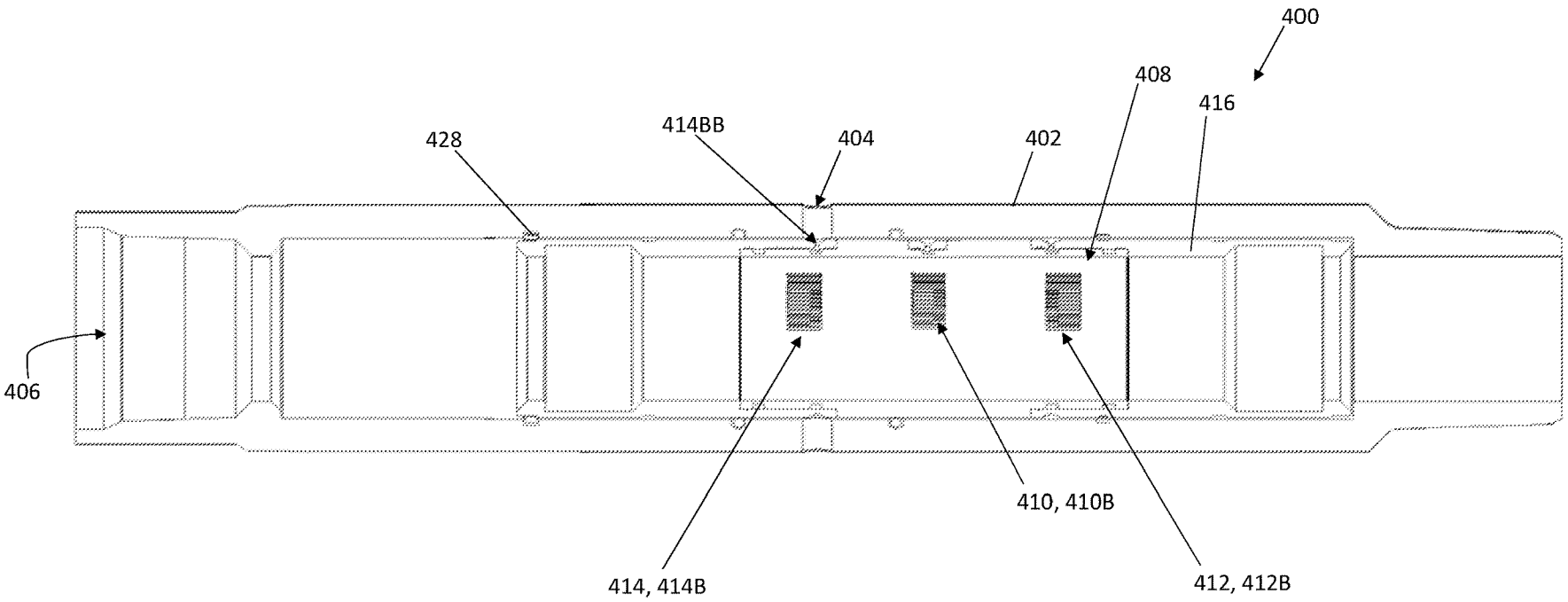

Referring to FIGS. 7 to 9, in a second embodiment, the apparatus (valve assembly) 400 is configurable in at least a first operational configuration (FIG. 7), a second operational configuration (FIG. 8), and a third operational configuration (FIG. 9). Each one of the first, second, and third operational configurations, independently, define first, second, and third choked configurations, respectively. In some embodiments, for example, each one of the operational configurations, independently, corresponds to an alignment between corresponding flow modulators (of the flow controller 408) and the housing flow communicator (housing outlet) 404. More specifically, the first operational configuration corresponds to an alignment between the first flow modulator 410 and the housing flow communicator (housing outlet) 404. The second operational configuration corresponds to an alignment between the second flow modulator 412 and the housing flow communicator 404. The third operational configuration corresponds to an alignment between the third flow modulator 414 and the housing flow communicator 404.

In some embodiments, for example, the first flow modulator, or central flow modulator 410, can include a first flow modulator-defining flow communicator (central sleeve outlet) 410B. As described above with respect to the first embodiment, the second flow modulator includes the second flow modulator-defining flow communicator (downhole sleeve outlet) 412B, and the third flow modulator 414 includes the third flow modulator-defining flow communicator (uphole sleeve outlet) 414B. The housing 402 and the flow controller 408 can be co-operatively configured such that, while the first flow modulator-defining flow communicator (central sleeve outlet) 410B is aligned with the housing flow communicator (housing outlet) 404, flow communication between the fluid conducting passage 406 and the environment external to the housing is effected/established via a first operational configuration-defined flow communicator (a first fluid pathway 410BB defined by the alignment of the central sleeve outlet 410B and housing outlet 404) having a first flow modulator-defining resistance to material flow.

In this embodiment, while the second flow modulator-defining flow communicator (downhole sleeve outlet) 412B is aligned with the housing flow communicator (housing outlet) 404, flow communication between the fluid conducting passage 406 and the environment external to the housing is effected/established via a second operational configuration-defined flow communicator (a second fluid pathway 412BB defined by the alignment of the downhole sleeve outlet 412B and housing outlet 404) having a second flow modulator-defining resistance to material flow, and while the third flow modulator-defining flow communicator (uphole sleeve outlet) 414B is aligned with the housing flow communicator (housing outlet) 404, flow communication between the fluid conducting passage 406 and the environment external to the housing is effected/established via a third operational configuration-defined flow communicator (a third fluid pathway 414BB defined by the alignment of the uphole sleeve outlet 414B and housing outlet 404) having a third flow modulator-defining resistance to material flow.

With respect to the communicators (central, downhole and uphole outlets) 410B, 412B, 414B, in some embodiments, for example, each one of the communicators 410B, 412, 414B, independently, is in the form of a passage. The third flow modulator-defining resistance to material flow can be greater than the second flow modulator-defining resistance to material flow, and the second flow modulator-defining resistance to material flow can be greater than the first flow modulator-defining resistance to material flow, although other configurations are possible. In some of these embodiments, for example, the third flow modulator-defining resistance to material flow is greater than the second flow modulator-defining resistance to material flow by a multiple of at least 1.25, such as, for example, at least 1.5, such as, for example, at least two (2), such as, for example at least five (5), and the second flow modulator-defining resistance to material flow is greater than the first flow modulator-defining resistance to material flow by a multiple of at least 1.25, such as, for example, at least 1.5, such as, for example, at least two (2), such as, for example at least five (5).

In some of these embodiments, for example, the minimum cross-sectional flow area of the first flow modulator-defining flow communicator (central sleeve outlet) 410B is greater than the minimum cross-sectional flow area of the second flow modulator-defining flow communicator (downhole sleeve outlet) 412B, and the minimum cross-sectional flow area of the second flow modulator-defining flow communicator (downhole sleeve outlet) 412B is greater than the minimum cross-sectional flow area of the third flow modulator-defining flow communicator (uphole sleeve outlet) 414B. In some of these embodiments, for example, the first flow modulator-defining flow communicator 410B includes a tortuous flow path-defining fluid passage (first fluid pathway) 410BB that defines a tortuous flow path, the second flow modulator-defining flow communicator 412B includes a tortuous flow path-defining fluid passage (second fluid pathway) 412BB that defines a tortuous flow path, and the third flow modulator-defining flow communicator 414B includes a tortuous flow path-defining fluid passage (third fluid pathway) 414BB that defines a tortuous flow path.

In those embodiments where the first, second, and third operational configurations define first, second, and third choked configurations, respectively, in some of these embodiments, for example, a process for effecting/establishing material flow between the surface 102 and the subterranean formation 101 is provided, and the process includes:

emplacing the flow control apparatus (valve assembly) 400 in the first operational configuration (FIG. 7);

effecting a change in the operational configuration of the flow control apparatus 400, with effect that the operational configuration of the flow control apparatus 400 changes from the first operational configuration to one of the second and third operational configurations (FIGS. 8 and 9);

while the flow control apparatus 400 is disposed in the one of the second and third operational configurations, effecting material flow between the surface 102 and the subterranean formation 101;

effecting a change in the operational configuration of the flow control apparatus 400, with effect that the operational configuration of the flow control apparatus 400 changes from the one of the second and third operational configurations to the other one of the second and third operational configurations; and while the flow control apparatus 400 is disposed in the other one of the second and third operational configuration, effecting material flow between the surface 102 and the subterranean formation 101.

In some embodiments, for example, the change in the operational configuration of the flow control apparatus 400, with effect that the operational configuration of the flow control apparatus 400 changes from the one of the first and second operational configurations to the other one of the first and second operational configurations, is effected in response to detection of a condition that is representative of the efficiency of the material flow being effected between the surface 102 and the subterranean formation 101 while the flow control apparatus is disposed in the one of the first and second operational configurations. Also, the change in the operational configuration of the flow control apparatus 400, with effect that the operational configuration of the flow control apparatus 400 changes from the one of the second and third operational configurations to the other one of the second and third operational configurations, is effected in response to detection of a condition that is representative of the efficiency of the material flow being effected between the surface 102 and the subterranean formation 101 while the flow control apparatus is disposed in the one of the second and third operational configurations.

In those embodiments where the process includes stimulation of hydrocarbon production from the subterranean formation 101, in some of these embodiments, for example, the material flow, which is effected while the flow control apparatus 400 is disposed in the first operational configuration, is for injecting material, at a first flowrate, into the subterranean formation 101, for displacing hydrocarbon material from the subterranean formation 101 to the surface 102, the material flow, which is effected while the flow control apparatus 400 is disposed in the second operational configuration, is for injecting material, at a second flowrate, into the subterranean formation 101, for displacing hydrocarbon material from the subterranean formation 101 to the surface 102, and the material flow, which is effected while the flow control apparatus 400 is disposed in the third operational configuration, is for injecting material, at a third flowrate, into the subterranean formation 101, for displacing hydrocarbon material from the subterranean formation 101 to the surface 102, and the first flowrate is greater than the second flowrate, and the second flowrate is greater than the third flowrate.

Figure 10:
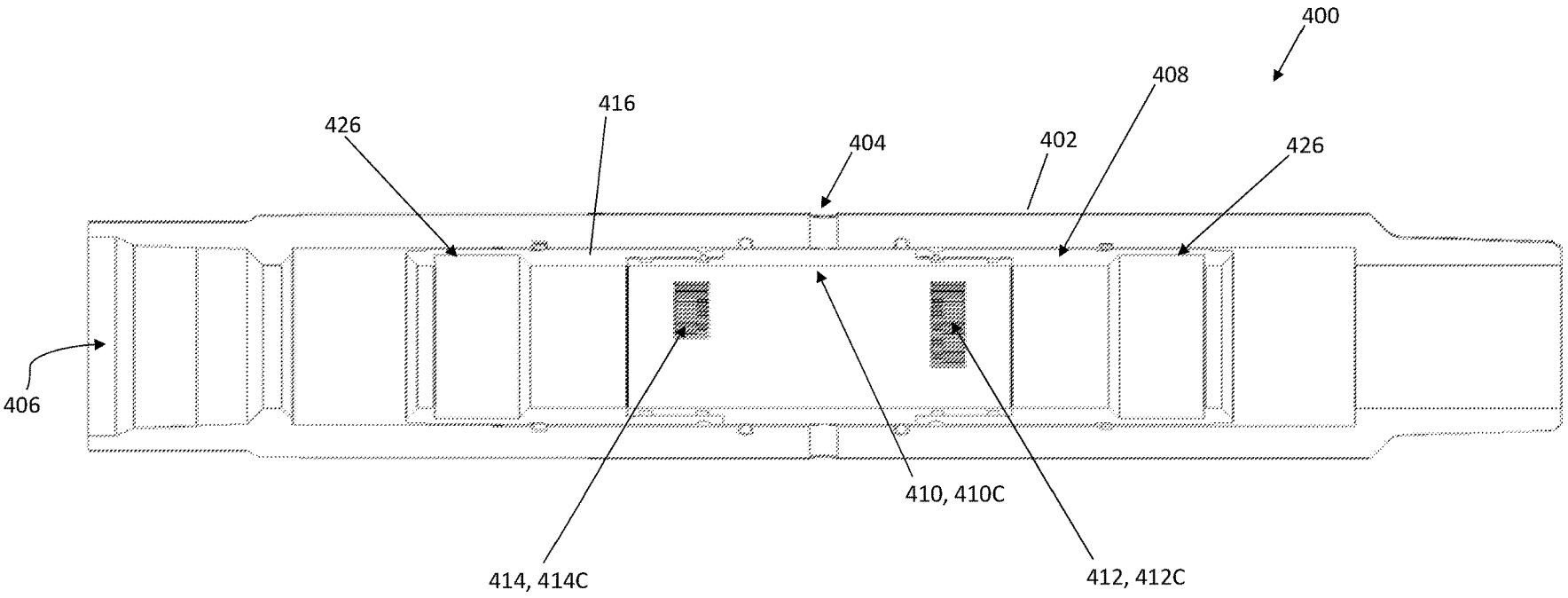
FIGS. 10 to 12 are sectional views of a third embodiment of a flow control apparatus, illustrated in a first configuration (FIG. 10), a second configuration (FIG. 11), and a third configuration (FIG. 12)
Figure 11:
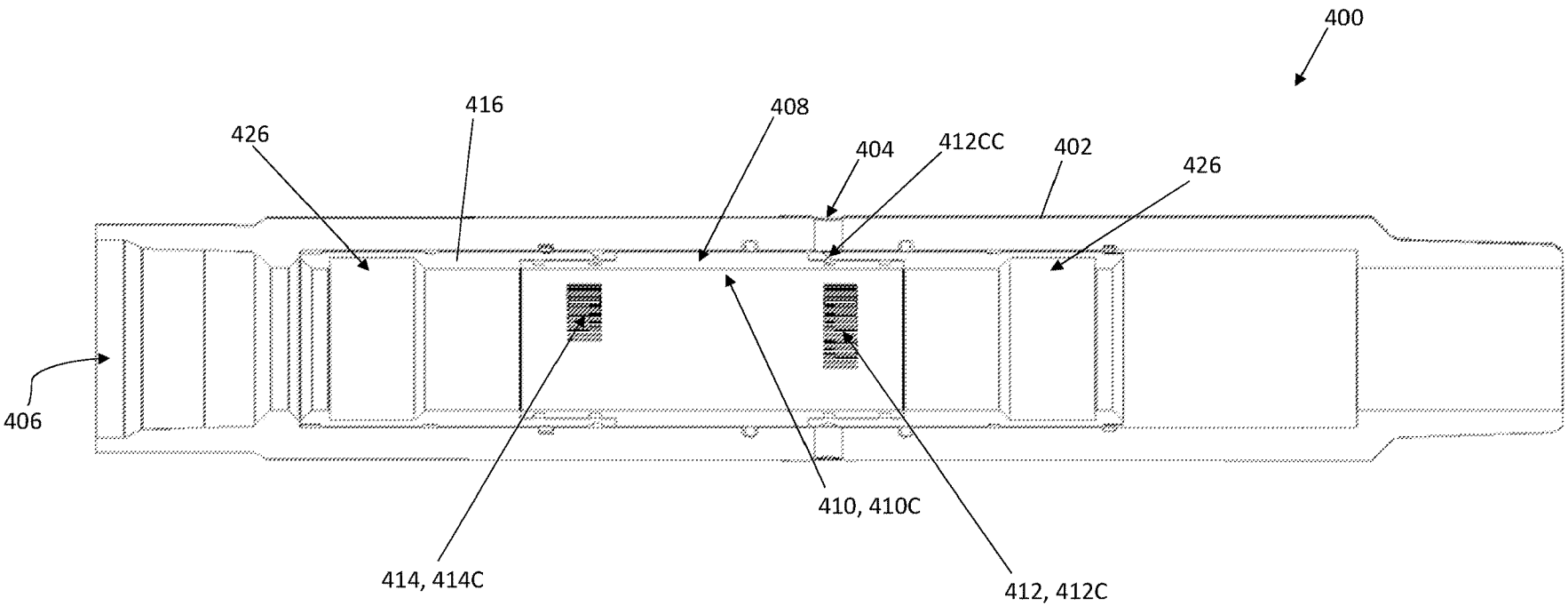
Figure 12:
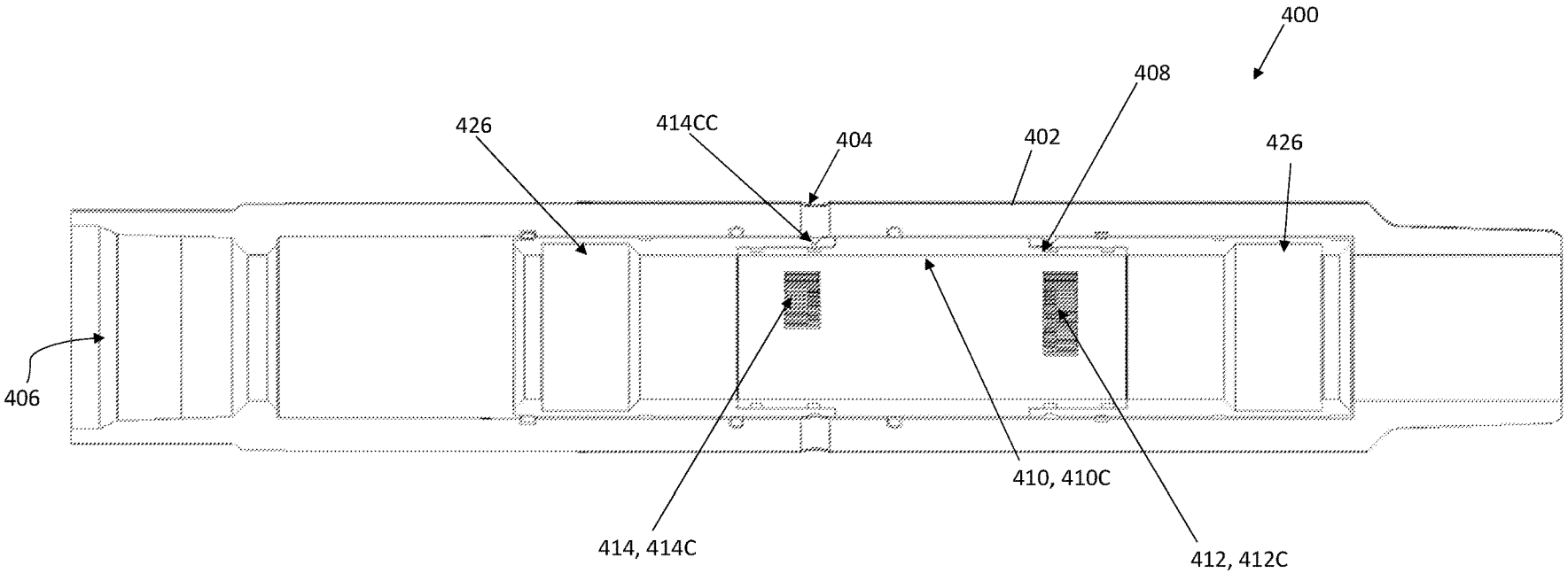

Referring to FIGS. 10 to 12, in a third embodiment, the apparatus (valve assembly) 400 is configurable in at least a first operational configuration (FIG. 10), a second operational configuration (FIG. 11), and a third operational configuration (FIG. 12). The first operational configuration defines a closed configuration, the second operational configuration defines a relatively high throughput configuration, and third operational configurations defines a choked configuration. In this embodiment, the flow controller 408 can include a first flow modulator 410, a second flow modulator 412, and a third flow modulator 414. In some embodiments, each one of the operational configurations, independently, corresponds to an alignment between a respective flow modulator (of the flow controller 408) and the housing flow communicator (housing outlet) 404. The first operational configuration corresponds to alignment between a first flow modulator 410 and the housing flow communicator 404. The second operational configuration corresponds to alignment between a second flow modulator 412 and the housing flow communicator 404. The third operational configuration corresponds to alignment between a third flow modulator 414 and the housing flow communicator 404.

In some embodiments, for example, the first flow modulator 410 is defined by a closure element 410C configured for effecting closure of the housing flow communicator 404, similar to the first flow modulator 410 defined in relation with the first embodiment of the flow control apparatus (valve assembly) 400 described above (FIGS. 4 to 6). Additionally, the second flow modulator 412 defines a second flow modulator-defining flow communicator (downhole sleeve outlet) 412C, and the third flow modulator 414 defines a third flow modulator-defining flow communicator (uphole sleeve outlet) 414C, similar to the first embodiment of the flow control apparatus (valve assembly) 400. More specifically, in this embodiment, the first flow modulator 410 represents a central flow modulator positioned between the second and third flow modulators 412, 414. Moreover, the second and third flow modulators represent the downhole flow modulator 412 and the uphole flow modulator 414, respectively. However, in this embodiment, the downhole sleeve outlet 412C is shaped and configured to define a relatively high throughput of fluid therethrough.

With respect to the communicators (downhole and uphole sleeve outlets) 412C, 414C, in some embodiments, for example, each one of the communicators 412C, 414C, independently, is in the form of a passage. In some of these embodiments, for example, third flow modulator-defining resistance to material flow is greater than the second flow modulator-defining resistance to material flow by a multiple of at least 50, such as, for example, at least 100, such as, for example, at least 200. In some of these embodiments, for example, the minimum cross-sectional flow area of the second flow modulator-defining flow communicator (downhole sleeve outlet) 412C is greater than the minimum cross-sectional flow area of the first flow modulator-defining flow communicator (uphole sleeve outlet) 414C. In some of these embodiments, for example, the second flow modulator-defining flow communicator (downhole sleeve outlet) 412C has ports having a central longitudinal axis that is straight for communicating with the ports of the housing outlet 404 (e.g., as seen in FIGS. 25 to 28), and the third flow modulator-defining flow communicator 414C includes a tortuous flow path-defining fluid passage 414CC that defines a tortuous flow path. Alternatively, the downhole sleeve outlet 412C can include a tortuous flow path-defining fluid passage 412CC that defines a tortuous flow path, but the inlet to the tortuous flow path can be larger relative to an inlet of the tortuous flow path defined by the uphole sleeve outlet (e.g., as seen in FIGS. 10 to 12). Therefore, it should be appreciated that the flowrate of fluids flowing through the downhole sleeve outlet 412C is greater than the flowrate of fluids flowing through the uphole sleeve outlet 414C.

In those embodiments where the first operational configuration defines a closed configuration, the second operational configuration defines a relatively high throughput configuration, and the third operational configuration defines a choked configuration, in some of these embodiments, for example, a process for effecting/establishing material flow between the surface 102 and the subterranean formation 101 is provided, and the process includes:

emplacing the flow control apparatus 400 in the first operational configuration, i.e., the closed configuration;

effecting a change in the operational configuration of the flow control apparatus 400, with effect that the operational configuration of the flow control apparatus 400 changes from the first operational configuration to the second operational configuration, i.e., from the closed configuration to the relatively high throughput configuration;

while the flow control apparatus 400 is disposed in the second operational configuration, effecting/establishing material flow between the surface 102 and the subterranean formation 101;

effecting a change in the operational configuration of the flow control apparatus 400, with effect that the operational configuration of the flow control apparatus 400 changes from the second operational configurations to the third operational configuration, i.e., from the relatively high throughput configuration to the choked configuration; and while the flow control apparatus 400 is disposed in the third operational configuration, effecting material flow between the surface 102 and the subterranean formation 101.

Figure 21:
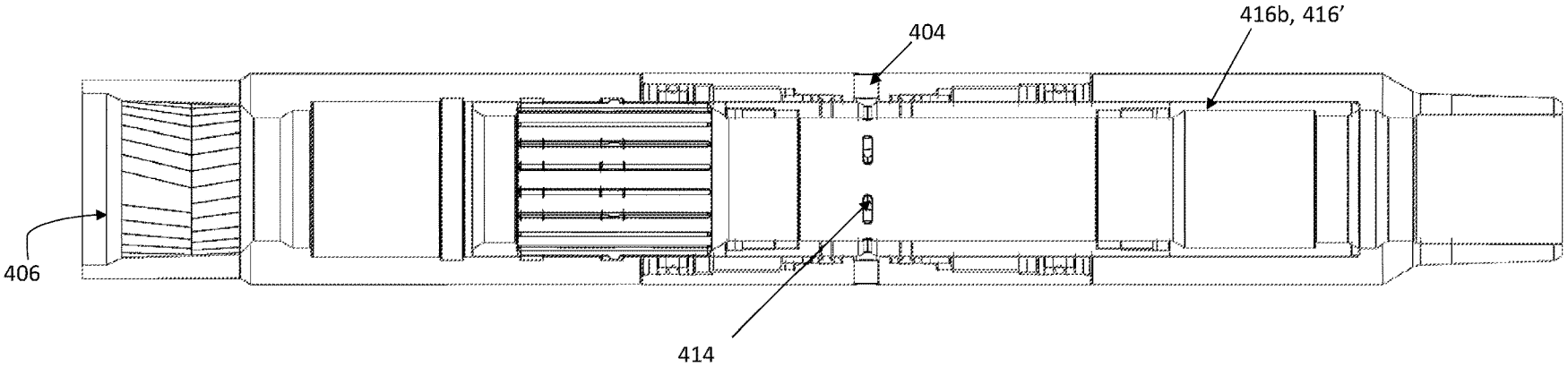
Figure 24:
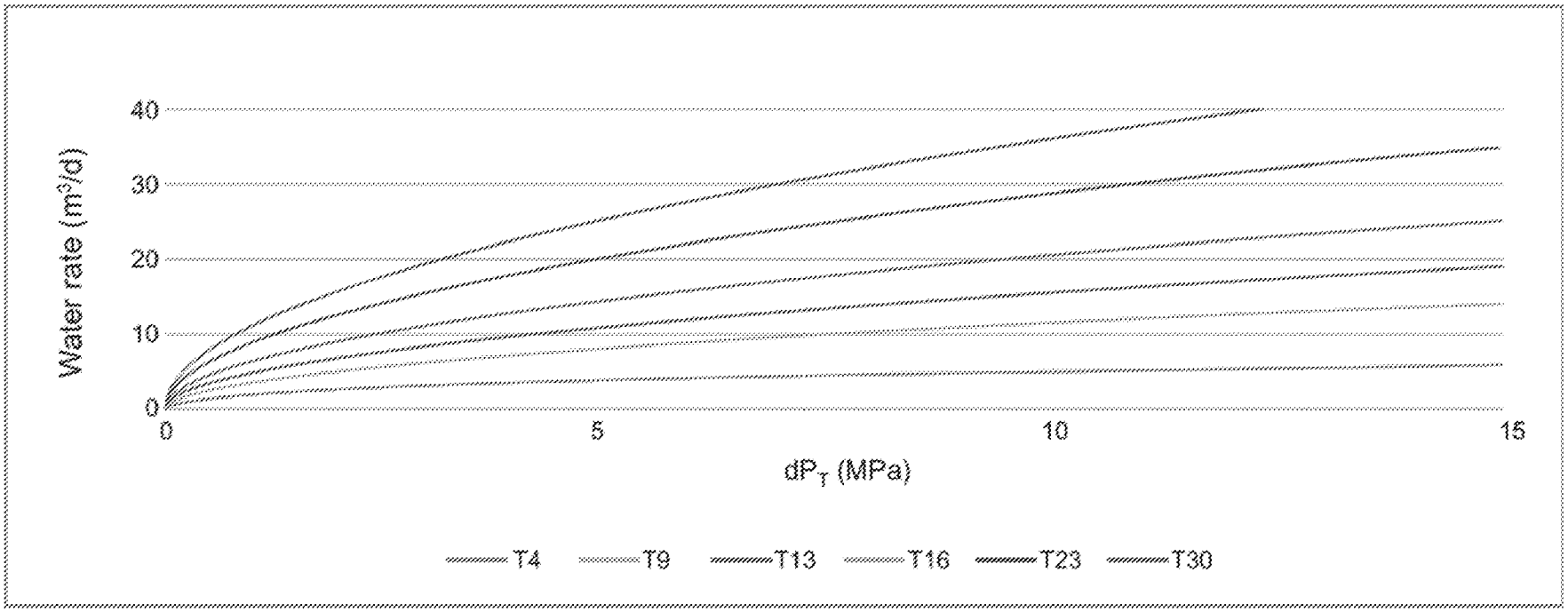
FIGS. 24 and 25 are model graphs representing input pressures across a valve provided within a wellbore and the corresponding output flow rate for a plurality of valve configurations, according to possible embodiments.

In those embodiments where the process includes stimulation of hydrocarbon production from the subterranean formation 101, in some of these embodiments, for example, the material flow, which is effected while the flow control apparatus 400 is disposed in the second operational configuration, is for filling void space, at a first flowrate, of the subterranean formation 101, and the material flow, which is effected while the flow control apparatus 400 is disposed in the third operational configuration, is for injecting material, at a second flowrate, into the subterranean formation 101, for displacing hydrocarbon material from the subterranean formation 101 to the surface 102, and the first flowrate is greater than the second flowrate. It should thus be understood that the valve assembly 400 can be installed in a production well in order to effectively retrofit the well for injection of fluids, such as water (e.g., waterflooding), at high flowrates to fill the voids created within the subterranean formation from previous hydrocarbon production. It should be noted that production of hydrocarbon from the subterranean formation to the surface is done via another well (i.e., a separate well from the retrofitted production well), In some embodiments, the flow controller 408 can include a single flow modulator adapted to establish fluid communication between the fluid conducting passage 406 and the environment external to the housing 402. For example, in some embodiments, only the downhole flow modulator 412 can include an outlet (i.e., a downhole sleeve outlet) adapted to establish fluid communication between the fluid conducting passage 406 and the environment external to the housing 402 (FIGS. 21 and 22), while in other embodiments, only the uphole flow modulator 414 includes an outlet (uphole sleeve outlet) adapted to establish fluid communication between the fluid conducting passage 406 and the environment external to the housing 402 (FIGS. 23 and 24). In other words, the valve assembly 400 can be configurable between at least a first operational configuration, corresponding to a run-in configuration or closed configuration (i.e., where the outlet is not aligned with the housing outlet 404), and a second operational configuration corresponding to a choked configuration or a relatively high throughput configuration (i.e., where the outlet aligned with the housing outlet 404). It should be understood that, in such implementations where the valve assembly 400 includes a single flow modulator, the third operational configuration corresponds to another closed configuration.

Referring broadly to FIGS. 4 to 12, in those embodiments where the flow control apparatus (valve assembly) 400 is configurable in at least one of the first, second, and third operational configurations, and where the flow controller 408 defines at least one of the first, second, and third modulators which are alignable with the flow communicator 404 to define the corresponding first, second, and third operational configurations, in some of these embodiments, for example, the flow controller 408 is a flow control member (also referred to as valve sleeve) 416. In some embodiments, for example, the flow control member 416 is in the form of a sleeve. In some embodiments, the flow control member 416 includes a first side 418 and a second opposite side 420. In those embodiments where the first flow modulator 410 is defined by the first flow modulator-defining flow communicator (central sleeve outlet) 410A, in some of these embodiments, the first flow modulator-defining flow communicator (central sleeve outlet) 410A extends from the first side 418 of the flow control member 416 to the second opposite side 420 of the flow control member 416, and, in this respect, the first flow modulator-defining flow communicator (central sleeve outlet) 410A extends through the flow control member 416 (i.e., through a thickness of the valve sleeve 416).

In those embodiments where the second flow modulator (downhole flow modulator) 412 is defined by the second flow modulator-defining flow communicator (downhole sleeve outlet) 412A, in some of these embodiments, for example, the second flow modulator-defining flow communicator 412A extends from the first side 418 of the flow control member 416 to the second opposite side 420 of the flow control member 416, and, in this respect, the second flow modulator-defining flow communicator 412A extends through the flow control member 416. In those embodiments where the third flow modulator (uphole flow modulator) 414 is defined by the third flow modulator-defining flow communicator (uphole sleeve outlet) 414A, in some of these embodiments, for example, the third flow modulator-defining flow communicator 414A extends from the first side 418 of the flow control member 416 to the second opposite side 420 of the flow control member 416, and, in this respect, the third flow modulator-defining flow communicator 414A extends through the flow control member 416

With respect to those embodiments where the flow controller 408 is the flow control member (valve sleeve) 416, in some of these embodiments, for example, a change in the operational configuration of the flow control member (valve sleeve) 416 is effectible in response to displacement of the flow control member (valve sleeve) 416 relative to the housing flow communicator 404. In this respect, the change from the first operational configuration to the second operational configuration is effectible in response to displacement of the flow control member (valve sleeve) 416 relative to the housing flow communicator 404 (e.g., in the downhole direction), and the change from the second operational configuration to the third operational configuration is also effectible in response to displacement of the flow control member (valve sleeve) 416 relative to the housing flow communicator 408 (e.g., in the uphole direction).

In some embodiments, for example, the displacement of the flow control member (valve sleeve) 416, relative to the housing flow communicator 404, is effected by a shifting tool, such as, for example, a Halliburton Otis B Shifting Tool™. In those embodiments where the shifting tool is a Halliburton Otis B Shifting Tool™, the flow control member 416 is configured with a complementary profile 426 suitable for mating with the shifting tool. In some embodiments, for example, the shifting tool is deployable via the wellbore string 200 for disposition relative to the flow communication station associated with the flow control apparatus 400, such that the shifting tool becomes disposed for effecting the displacement of the flow control member (valve sleeve) 416. In some embodiments, for example, the deployment is effected via a conveyance system (e.g. workstring) that is run into the wellbore string 200. Suitable conveyance systems include a tubing string or wireline, for example.

In some embodiments, for example, initially, the flow control apparatus 400 is disposed in the first operational configuration (the first flow modulator 410 is aligned with the housing flow communicator 404), and the flow control member (valve sleeve) 416 is releasably retained to the housing 402 with a defeatable retainer 428. It should thus be understood that the first operational configuration can correspond to a run-in configuration (i.e., the configuration of the valve sleeve 416 when the valve assembly 400 is installed within the well). In some embodiments, for example, the defeatable retainer 428 is one or more collets, such as, for example, in the manner described in U.S. Pat. No. 9,982,512, although other configurations of the defeatable retainer 428 and combination thereof are possible. In some embodiments, for example, the defeatable retainer 428 includes one or more frangible members. In this respect, in the initial configuration, the flow control member 416 is configured for release from the housing 402 in response to application of sufficient force, such as, for example, in the downhole direction.

In some of these embodiments, for example, the housing 402 further defines an downhole-disposed stop, or downhole shoulder 422 and an uphole-disposed stop, or uphole shoulder 424 for establishing the second operational configuration (i.e., when the second flow modulator 412 is aligned with the housing flow communicator 404) and the third operational configuration (i.e., when the third flow modulator 414 is aligned with the housing flow communicator 404), respectively, of the flow control apparatus 400. The downhole-disposed stop 422 is configured for preventing downhole displacement of the flow control member (valve sleeve) 416 relative to the downhole-disposed stop 422. For example, the downhole shoulder 422 can protrude inwardly (e.g., within the fluid conducting passage 406) to effectively have the flow control member (valve sleeve) 416 abut thereon, thus preventing further downhole movement. The uphole-disposed stop 424 is configured for preventing uphole displacement of the flow control member 416 relative to the uphole-disposed stop 422. For example, the uphole shoulder 424 can protrude inwardly (e.g., within the fluid conducting passage 406) to effectively have the flow control member (valve sleeve) 416 abut thereon, thus preventing further uphole movement.

The housing 402 and the flow control member 416 are further co-operatively configured such that, while the flow control apparatus 400 is disposed in the first operational configuration (and, in some operational embodiments, while the flow control member 416 is releasably retained to the housing 402), the flow control member 416 is spaced-apart from the downhole-disposed stop 422 in the uphole direction, and is also spaced-apart from the uphole-disposed stop 424 in the downhole direction, and while the flow control member 416 is disposed in abutting engagement with one of the stops 422, 424, the apparatus 400 is disposed in the second operational configuration (the second flow modulator 412 is aligned with the housing flow communicator 404), and while the flow control member 416 is disposed in abutting engagement with the other one of the stops 422, 424, the flow control apparatus 400 is disposed in the third operational configuration (the third flow modulator 414 is aligned with the housing flow communicator 404).

In operation, to effect release of the flow control member 416 from the releasable retention to the housing 402, a sufficient force is applied in the downhole direction. Upon release, and in response to continued application of a force in the downhole direction, the flow control member 416 is moved in the downhole direction such that the flow control member 416 becomes disposed in the abutting engagement with the downhole-disposed stop 422, such that the flow control apparatus 400 becomes disposed in the third operational configuration. While the flow control apparatus 400 is disposed in the third operational configuration, to effect a change in the operational configuration of the flow control apparatus 400 to the second operational configuration, the flow control member 416 is displaced in an uphole direction relative to the stop 422, with effect that the flow control member 416 becomes disposed in abutting engagement with the uphole-disposed stop 424, such that the second operational configuration of the flow control apparatus 400 is established.

In those embodiments where, initially, the flow control apparatus 400 is disposed in a first operational configuration that effects/establishes flow communication between the surface 102 and the subterranean formation 101 (e.g. see FIGS. 7 to 9), in some of these embodiments, for example, the packers, of the sealed interfaces 108 that define a wellbore interval 109, are swellable, so that their actuation is not dependent on pressurized fluid. If, on the other hand, the packers are hydraulically-set packers, embodiments of the flow control apparatus 400, whose first operational configuration effects flow communication between the surface 102 and the subterranean formation 101, may not be useable as it may not be possible to sufficiently pressurize the wellbore to effect actuation of such packers while flow communication is established between the surface 102 and the subterranean formation 101.

Prior to stimulation of hydrocarbon production, where it is initially desirable to supply fluid material to the subterranean formation via an opened flow communicator 404 (such as, for example, for purposes of characterizing the reservoir, or for filling voidage within the subterranean formation 101 with fluid prior to initiating a displacement process), and the packers being used are set hydraulically (i.e. by pressurized fluid), it may, in some embodiments, be preferable to avoid using embodiments of the flow control apparatus 400 which, initially, are disposed in an operational configuration that effects flow communication between the surface 102 and the subterranean formation 101. In some embodiments, for example, where the supplied fluid material is for filling voidage within the subterranean formation, such operation is known as "voidage replacement". In this respect, the supplied fluid material is used to fill voidage within the reservoir that has resulted from previous production of hydrocarbon material from the subterranean formation, and such previous production has only been successful in extracting some of the hydrocarbon material originally present in the subterranean formation 101, so as to condition the subterranean formation for subsequent production of at least a fraction of the remaining hydrocarbon material via a displacement process.

Figure 13:
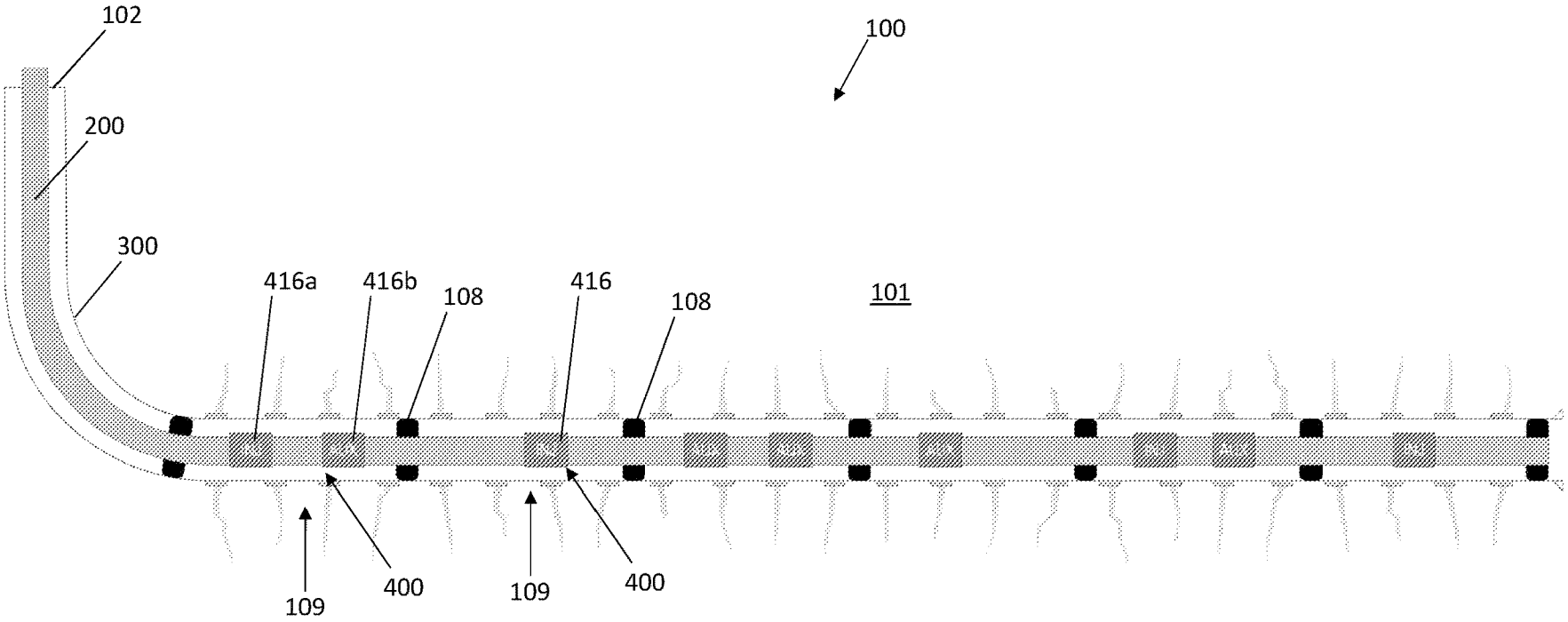
FIG. 13 is a schematic illustration of an embodiment of a well system, showing a plurality of valve assemblies disposed in respective wellbore intervals, according to an embodiment.

With reference to FIGS. 13 to 21, various configurations of the well system are illustrated. For example, and as seen in FIG. 13, the first wellbore interval can be provided with a flow control apparatus 400 comprising two spaced-apart valve sleeves 416*a*, 416*b*, followed by the second wellbore interval which can be provided with a flow control apparatus 400 having a single valve sleeve 416. In some embodiments, the first and second valves 416*a*, 416*b* can be substantially identical to one another, or have different configurations, shapes, sizes, methods of use, etc. Each wellbore interval can be provided with any suitable number of valves, and thus any suitable number of valve sleeves 416, such as a single valve sleeve, a pair of valve sleeves and three or more valve sleeves, for example.

Figure 14:
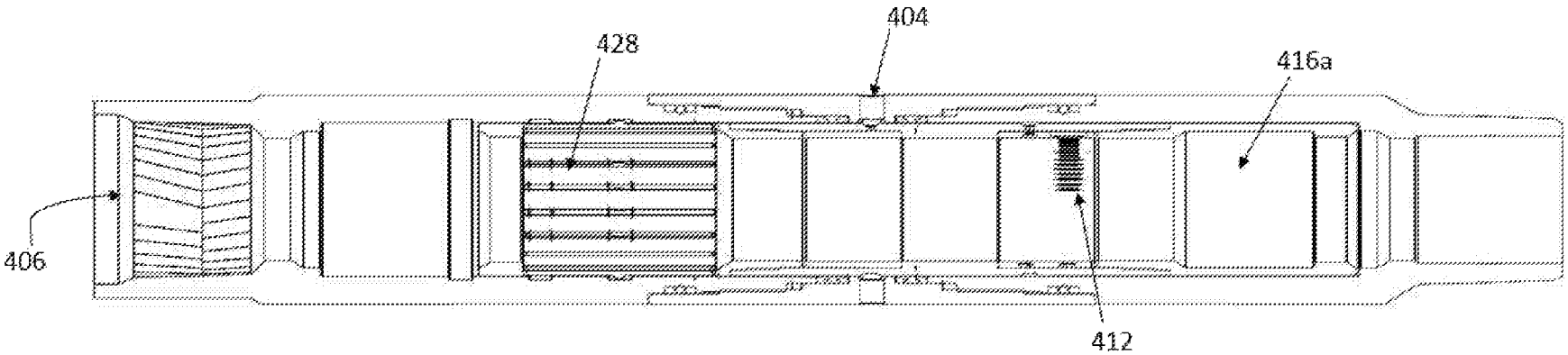
FIGS. 14 to 21 are sectional views of a flow control apparatus according to other embodiments, showing a single outlet for establishing fluid communication between the flow control apparatus and an environment external thereto.
Figure 15:
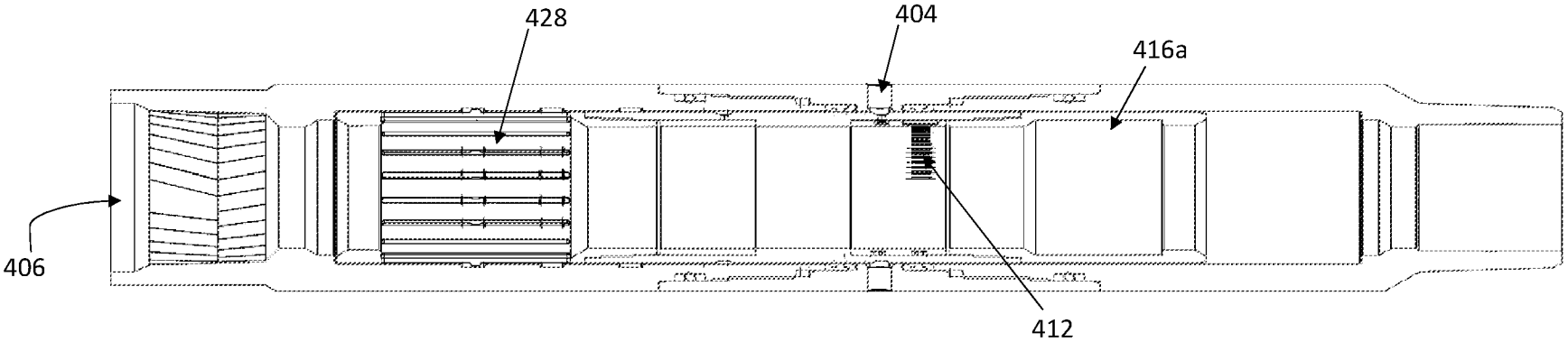
Figure 16:
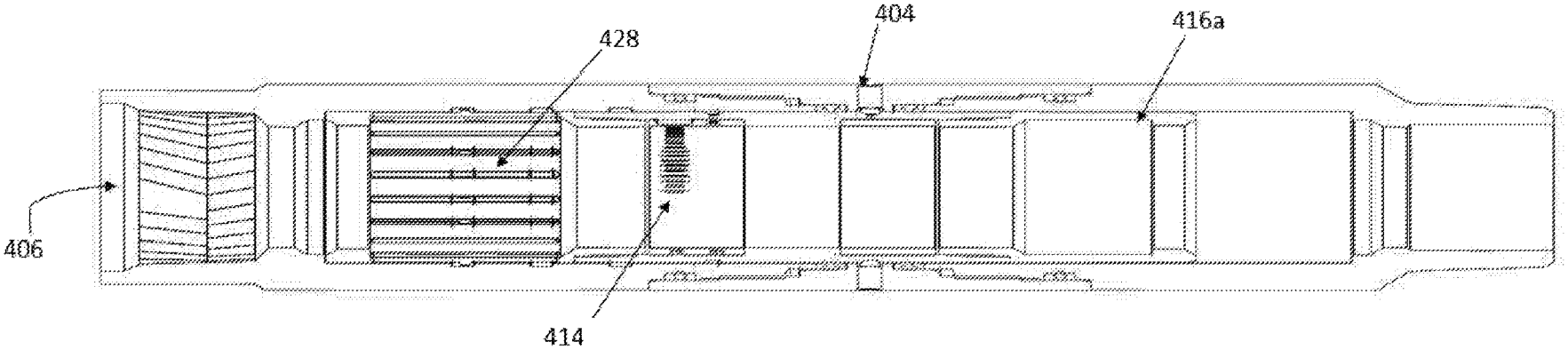
Figure 17:
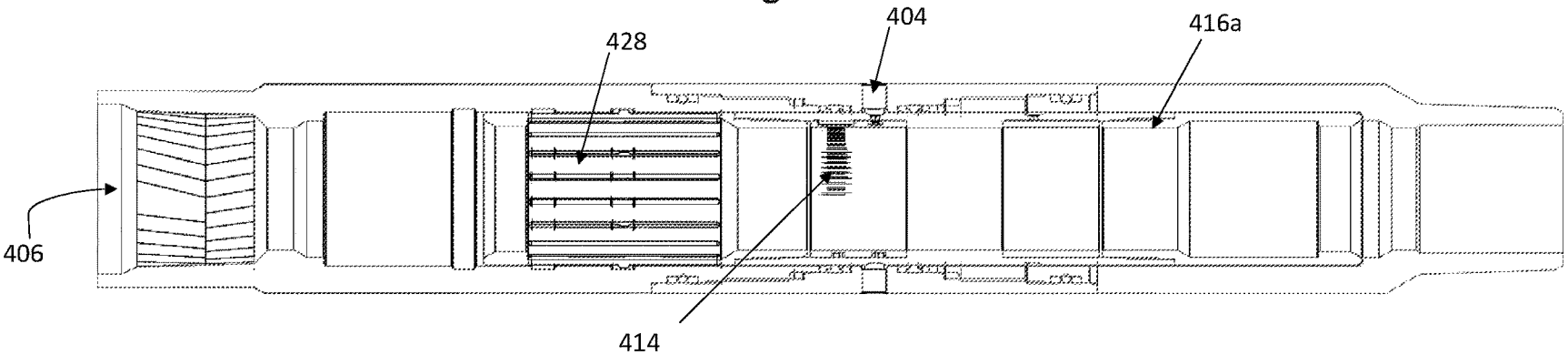
Figure 18:
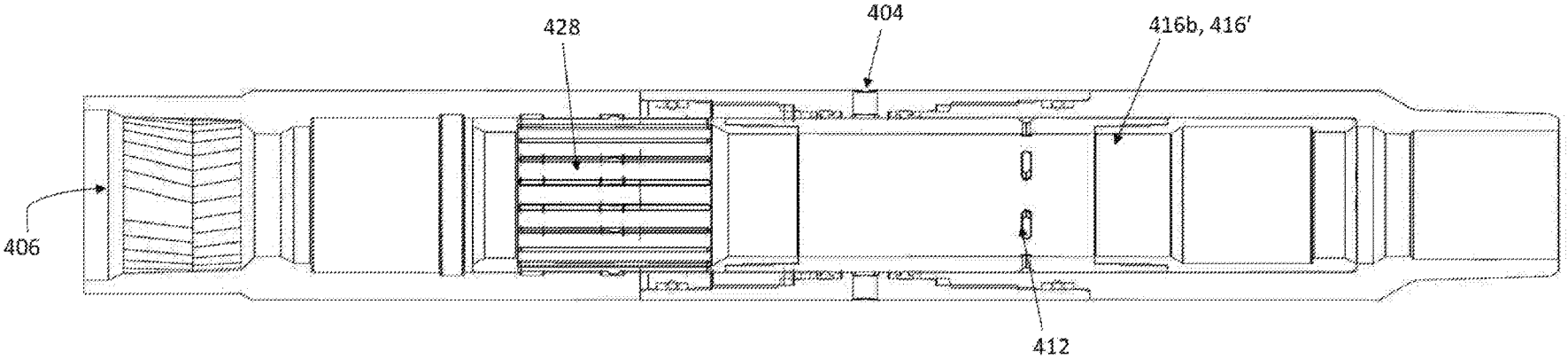
Figure 19:
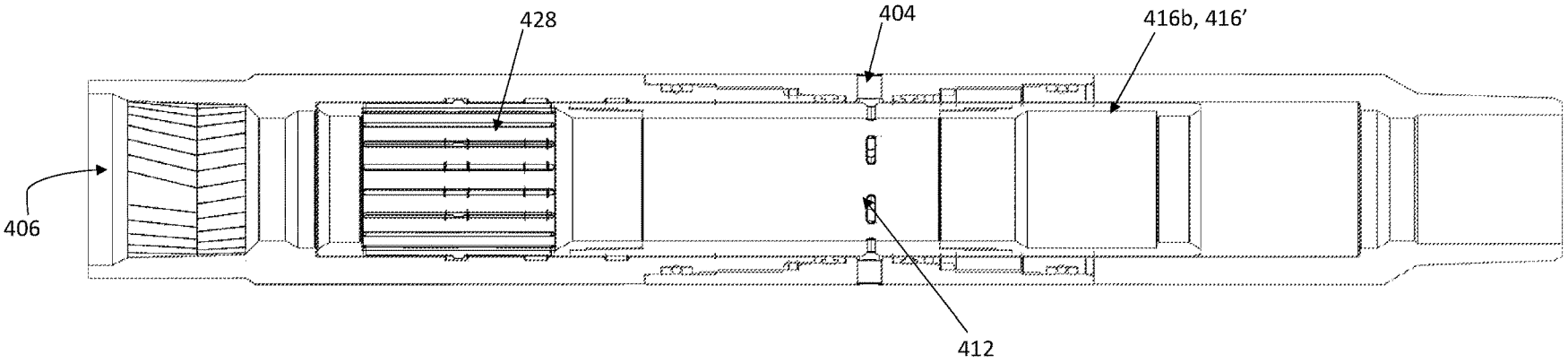
Figure 20:
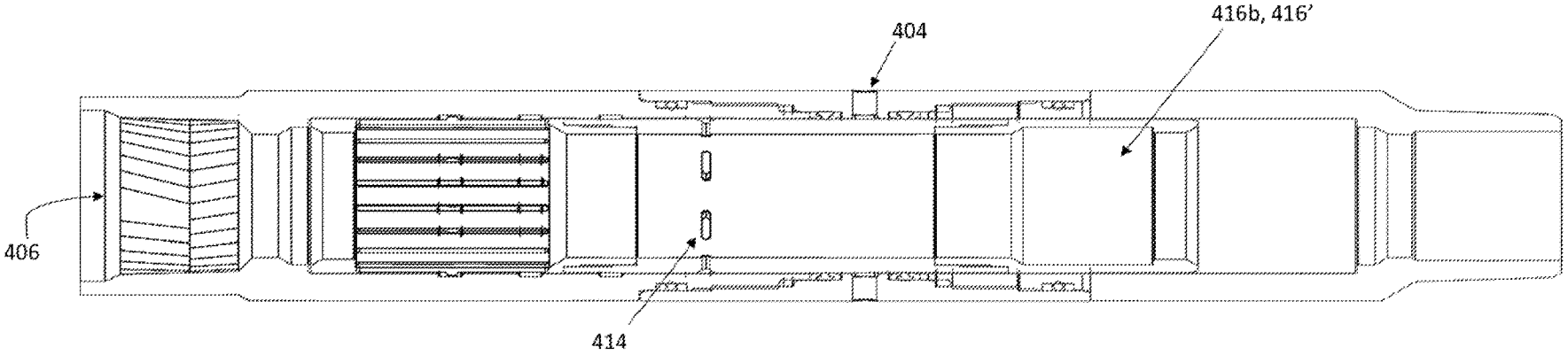

In some embodiments, the first valve sleeve 416*a* can be embodied by any one of the above described embodiments of the valve assembly 400 or include any of the above described features (alone or in combination), although other configurations are possible. In this embodiment, and with reference to FIGS. 14 to 17, the first valve sleeve 416*a* is configurable between two operational configurations, namely an open configuration (FIGS. 15 and 17) and a closed configuration (FIGS. 14 and 16). It should thus be understood that the first valve sleeve 416*a* includes a single outlet, which can be disposed proximate the downhole end of the valve sleeve 416 (i.e., downhole outlet 412—seen in FIGS. 14 and 15) or proximate the uphole end of the valve sleeve 416 (i.e., uphole outlet 414—seen in FIGS. 16 and 17). It should be understood that the first valve sleeve 416*a* is shifted uphole into the open configuration when the outlet is proximate the downhole end, and is shifted downhole in the open configuration when the outlet is proximate the uphole end. As described above, the first valve sleeve 416*a* can be shifted along the valve housing using a shifting tool, or using any other suitable method or device.

Furthermore, the second valve sleeve 416*b* can be embodied by any one of the above described embodiments of the valve assembly 400 or include any of the above described features (alone or in combination), although other configurations are possible. In this embodiment, and with reference to FIGS. 18 to 21, the second valve sleeve 416*b* can be an auxiliary valve sleeve 416'. As described above in relation with the first valve sleeve 416*a*, the second valve sleeve 416*b* can be configurable between a closed configuration (FIGS. 18 and 20) and an open configuration (19 and 21). As illustrated, the auxiliary valve sleeve 416' can be provided with a single outlet, which can be disposed proximate the downhole end thereof (i.e., downhole outlet 412—seen in FIGS. 18 and 19) or proximate the uphole end thereof (i.e., uphole outlet 414—seen in FIGS. 20 and 21). It is appreciated that valve sleeves having two operational configurations, such as those illustrated in FIGS. 14 to 21, include a closed run-in configuration where the valve sleeve is held in position within the housing, for example, via the defeatable retainer 428.

In those embodiments where the valve sleeves 416 can be displaced, relative to the housing via a shifting tool, the valve sleeves 416 can be adapted to be shifted downhole when running the shifting tool downhole, for example via a workstring. However, in some embodiments, the auxiliary valve sleeves 416' can be shaped and configured to allow the shifting tool to be run in hole (i.e., deployed downhole) without shifting the auxiliary valve sleeve 416' downhole, thereby maintaining the auxiliary valve sleeves 416' in their run-in-hole configurations (e.g., the closed configuration).

In some embodiment, the valve sleeves and auxiliary valve sleeves 416, 416' are run-in-hole in the closed configuration, although it is appreciated that other configurations are possible. Once in position, a shifting tool can be inserted via a workstring to shift the valve sleeves 416 downhole, thus opening the housing outlets 404 and establishing fluid communication between the fluid conducting passage 406 and the reservoir. It should be understood that shifting the valve sleeves 416 downhole can configure the valve assemblies 400 for injection of fluid within the reservoir. It should also be understood that, since the shifting tool does not shift the auxiliary valve sleeves 416' downhole, the auxiliary valve sleeves 416' remain in the closed configuration. However, when pulling the shifting tool out of the hole (i.e., out of the well), both the valve sleeves 416 and auxiliary valve sleeves 416', or only the auxiliary valve sleeves 416', can be configured to be shifted uphole, thus establishing fluid communication between the fluid conducting passage 406 and the reservoir via one or both valve sleeves. Once the shifting tool has been pulled out and recovered from within the well, the valve assembly can be configured for either production of fluids (e.g., hydrocarbons) from the reservoir, or injection of fluids at a higher or lower flowrate.

Using a second, or auxiliary valve sleeve 416' along the same wellbore interval as another valve sleeve 416 enables fluid communication between the tubing string and the surrounding reservoir at an increased flowrate. Injecting fluids at an increased flowrate can be useful in voidage replacement, as described above, or for waterflooding applications, for example. During operation, each valve along a given wellbore interval can be initially configured in an open configuration to fill the voids within the subterranean formation. Once the wellbore intervals are filled, an operator can configure each valve sleeve, individually or in combination, in any suitable configuration (e.g., closed, choked, high throughput, etc.) appropriate for the desired operation. As seen in FIG. 13, each valve along a wellbore interval is preferably spaced from one another to facilitate mechanically displacing the sleeves individually (e.g., manually moving the sleeves via a shifting tool), although other configurations are possible.

With respect to the tortuous flow path-defining fluid passages described herein, such as, tortuous flow path-defining fluid passages 412AA, 414AA, 410BB, 412BB, 414BB, 412CC and 414CC, for example, suitable embodiments of the tortuous flow path-defining fluid passages, include the exemplary embodiments described in International Patent Publication No. WO2018/161158. In some embodiments, the tortuous flow path-defining fluid passage is defined along an exterior surface of at least one of the flow modulators. With reference to FIGS. 22A to 23F, it is appreciated that the tortuous flow path-defining fluid passage can have any suitable configuration and/or cross-sectional shape in order to reduce the flowrate of fluids flowing between the tubing string and the surrounding reservoir. It should be understood that the choked configuration can be configured to limit the flowrate of fluids due in part to a length of the tortuous flow path-defining fluid passage. More specifically, and for example, a longer fluid passage increases the distance fluid has to travel to flow from the tubing string to the reservoir, or vice versa, and thus increases resistance to flow. In addition, the cross-sectional shape and size of the tortuous flow path-defining fluid passages can further limit fluid flowrates through the fluid passage. Smaller cross-sections generally increase resistance to flow. Various possible cross-sectional shapes are illustrated in FIGS. 23A to 23F, although it is appreciated that the illustrated embodiments are exemplary only, and that other configurations are possible. It is also noted that the fluid passage that provides the choked flow could also have other shapes that are not tortuous, such as a straight line or a gradual curve or the like, in which case the resistance to flow could be provided by reducing the cross-sectional area of the passage.

Figure 25:
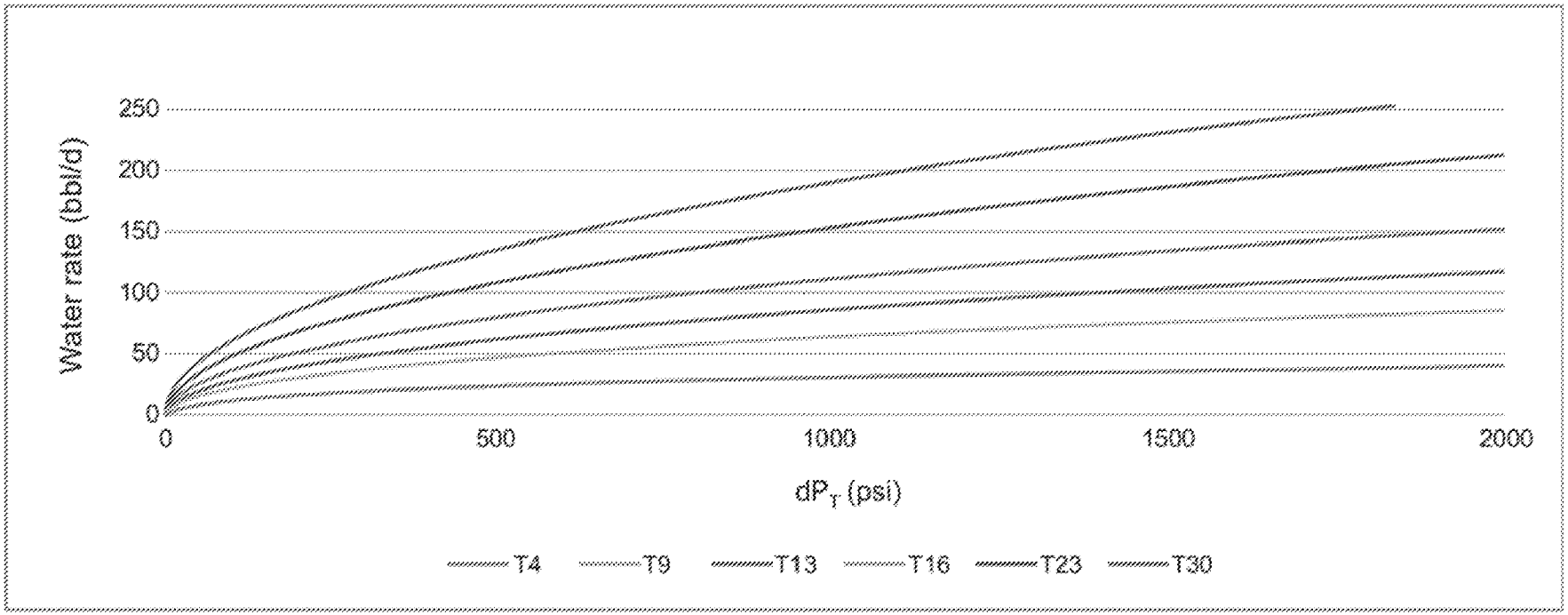

With reference to FIGS. 24 and 25, it is appreciated from the present disclosure that various configurations of the valves can be installed along a given wellbore interval, or across multiple wellbore intervals. Each interval could receive the same number and type of valves, or different arrangements of valves. The choice of the valves to install can depend on the intended application of the valve assemblies and the well in general. For example, a certain combination of valves can be used for a water flooding application, while another valve or combination of valves can be used for voidage replacement. The valves can also be selected based on the fluids being injected into the reservoir, such as liquids (e.g., water) or gases (e.g., carbon dioxide), or a combination thereof.

It is appreciated that choosing a particular valve configuration can refer to choosing a particular flow modulator, or combination of flow modulators for the valve. As seen in FIGS. 24 and 25, the flow modulators can be chosen based on at least one of the desired, or measured, pressure drop across the valve (i.e., between the tubing string and the reservoir) and the desired flow rate of fluid into (or from) the reservoir. In this embodiment, the flow modulators are identified (i.e., named on the graphs) based on a 7 MPa pressure drop across the fluid passage of the flow modulator; for example, a T4 flow modulator is adapted to provide a flowrate of 4 cubic meters of fluid per day, a T30 flow modulator is adapted to provide a flowrate of 30 cubic meters of fluid per day, and so on. It should be noted that the pressure differential across a given flow modulator is generally not the same as the applied surface pressure. For example, frictional pressure drop, restriction(s) into the reservoir (or lack thereof), and hydro-static differences can affect the pressure differential across the flow modulator. By accounting for these differences, and following the curves of FIGS. 24 and 25, the resulting flowrates can be determined.

As described above, a valve can be provided with two flow modulators (e.g., an uphole flow modulator and a downhole flow modulator). Therefore, a single valve can be provided with a first flow modulator providing a first flowrate, and a second flow modulator providing a second flowrate. In one embodiment, the first flowrate can be greater than the second flowrate, for example, the first flow modulator can be a T30, while the second flow modulator can be a T9. It should be noted that a single valve can have two of the same flow modulators at both the uphole and downhole positions. This configuration can be useful for long-term redundancy, in case of plugging or erosion of one of the flow modulators, for example. It is appreciated that providing each valve with predetermined flow regulators (e.g., T4, T9, T13, T30, etc.) effectively provides a predetermined range of fluid flowrates that a given wellbore interval can operate at. For example, if a low injection rate is desired, each valve can be operated in the closed configuration except for the valve having the T4 flow modulator. Therefore, the entire wellbore interval will have an injection rate of approximately 4 cubic meters of fluid per day.

By selecting certain combinations of valves and flow modulators (e.g., elongated passages) for a valve assembly in a given interval, the valve assembly can provide certain operational features. For example, valves can be selected so that at least two different configurations provide generally the same openness or flowrate capability. In this example, one could select a first valve to have T4 and T9 passages at uphole and down hole positions, and a second valve to have T4 and T13 passage at uphole and downhole positions, such that the overall valve assembly can be positioned with the first valve at T9 and the second valve at T4 for an overall flowrate of 13 cubic meters per day, or positioned with the first valve in the closed position and the second valve in the T13 position to provide the same flowrate but in a different configuration. It is noted that this is only one example and should be seen as illustrative for providing redundancy. Redundancy can also be provided by providing a valve with the same restriction at both uphole and downhole positions. Redundancy may also be more relevant for high choke passages since the risk of plugging may be greater, and thus one may select a first valve that has T4-T4 or T9-T9 positions, while the second valve may have only fully open and closed positions. Another example is where the first and second valves both have a high choke passage (e.g., T4) of the same type for redundancy, while having different second positions (e.g., fully open and closed, low choke and closed, low choke and fully open, etc.) such that redundancy is enabled only for the higher choked positions.

The valves can also be selected to provide higher precision adjustments within certain flow rate ranges compared to others, e.g., by enabling slight changes to the flowrate at lower flow rate ranges (e.g., 0-9 cubic meters per day), while providing less flexibility at higher flow rate ranges. For instance, a first valve could be provided with T4 and T9 passages while a second valve could be provided with a T9 passage and a fully open aperture for high throughput. In this scenario, one could adjust the two-valve assembly to provide various total choked flow rates (4, 9, 13 and 18 cubic meters per day) for more adjustability at the low range.

It should be noted that the valve assembly can be designed so that two, three, four or more valves are present in each interval; the valves can be identical or different from each other or some can be identical and others different in each interval; and the fluid passages can be chosen to provide one, two, three or more levels of choking depending on the configuration of the valve assembly. In addition, while the embodiment used to generate the graphs provides a certain distribution of flowrates (4, 9, 13, 16, 23, and 30 cubic meters per day at 7 MPa for water), it should be noted that the fluid passages can be designed to enable various other choking and flowrate properties depending on the application, valve construction, fluid properties, and/or process in which the valves are used.

In some embodiments, for example, one or more of the flow communication stations 110A-E includes the mechanically-actuatable flow control apparatus 400 and also includes the electrically-actuatable flow control apparatus. Suitable embodiments of the electrically-actuatable flow control apparatus include embodiments described in International Patent Application No. PCT/CA2019/050107. Like the flow control apparatus 400, the electrically-actuatable flow control apparatus is configured for conducting fluids between the surface 102 and the subterranean formation 101. In this respect, the electrically-actuatable flow control apparatus is configured for opening an apparatus flow communicator, in response to receiving of an electrical signal by the flow control apparatus, with effect that flow communication is effected between the surface 102 and the subterranean formation 101 In some embodiments, for example, while the apparatus flow communicator is effecting flow communication between the surface 102 and the subterranean formation, the apparatus flow communicator is characterized by an apparatus flow communicator-defined resistance to material flow.

In those embodiments where the flow communication station includes the mechanically-actuatable flow control apparatus 400 and also includes the electrically-actuatable flow control apparatus, in some of these embodiments, for example, a process for effecting material flow between the surface 102 and the subterranean formation 101 is provided, and the process includes:

electrically actuating the electrically-actuatable flow control apparatus, with effect that the apparatus flow communicator becomes disposed in the open condition;

determining that the opened apparatus flow communicator is ineffective for effecting flow communication between the surface 102 and the subterranean formation 101; and displacing the flow controller 408 of the mechanically-actuatable flow control apparatus 400 with a shifting tool, with effect that a change in the operational configuration of the flow control apparatus 400 is effected such that the flow control apparatus 400 changes from the first operational configuration to one of the second and third operational configurations.

In this respect, the flow control apparatus 400 is provided for effecting flow communication between the surface 102 and the subterranean formation in the event that the electrically-actuatable flow control apparatus is ineffective for effecting the desired flow communication. In some embodiments, for example, the electrically-actuatable flow control apparatus may have become ineffective due to loss of electrical communication with an electrical voltage and current source disposed at the surface, and the determining of the ineffectiveness is in response to sensing of the loss of electrical communication.

In some embodiments, for example, the apparatus flow communicator-defined resistance is greater than both of the second flow modulator-defining resistance to material flow and the third flow modulator-defining resistance to material flow, so that local solid debris, which may be interfering with the flow communication via the apparatus flow communicator, owing to the flow resistance characteristics of the apparatus flow communicator, are less likely to present the same degree of interference to the flow communication via the second flow modulator or the third flow modulator of the flow control apparatus 400.

It should be appreciated from the above description that the valve assembly offers improvements and advantages due to its versatility to adapt to a given situation or need. The valves of the assembly can include three configurations, namely a run-in-hole position where the sleeve is retained within the housing of the valve assembly, a downhole position and an uphole position. As described above, any one of these positions can define an open or closed configuration, respectively allowing or blocking fluid flow therethrough. The open configuration can include various sub-configurations, each establishing fluid communication between the well and the reservoir and providing respective flowrates. For example, the open configuration can be a choked configuration where fluid flow is restricted through the outlets of the sleeve, or a high throughput, or has "fill" configuration, where fluid flow is unimpeded and facilitated through the outlet of the sleeve. However, it is appreciated that any other configuration, or combination(s), are possible and may be useful with respect to the valve assembly. In addition, it should be noted that each stage of a well can be provided with any suitable number of valves, each having an open configuration defining respective fluid flowrates between the well and the reservoir. As such, each stage of the well can be operated to produce or inject fluids at a desired flowrate, selected within a predetermined range of possible flowrates.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A method for oil recovery from an existing wellbore previously operated for primary production and in which a tubing string is installed, the wellbore having a plurality of wellbore intervals isolated from one another by isolation devices deployed in spaced-apart relation to each other within an annulus defined between the tubing string and the wellbore, and where a valve assembly in installed in multiple wellbore intervals, the valve assembly comprising at least a first valve and a second valve to define a multivalve interval, each valve being operable in at least one of an open configuration for establishing fluid communication between the tubing string and the surrounding reservoir via respective fluid passages and a closed configuration for preventing fluid flow into the surrounding reservoir, the fluid passage of at least one of the first and second valves being elongated and configured such that the open configuration of the corresponding valve is a choked configuration where fluid flowrate from the tubing string into the reservoir is restricted, the method comprising:

determining at least one operational parameter comprising at least one property of an injection fluid, or at least one characteristic of the wellbore intervals, or a combination thereof;

based on the at least one determined operational parameter, for each wellbore interval, selectively operating the first valve and the second valve in the open or closed configuration to provide a selected openness for each valve assembly in the corresponding wellbore interval;

injecting at least one injection fluid down the tubing string so as to pass through at least one of the first valve and the second valve to enter the reservoir at corresponding wellbore intervals and promote recovery of oil via at least one adjacent production well.

2. A method for oil recovery from an existing wellbore previously operated for primary production and in which a tubing string is installed, the wellbore having a plurality of wellbore intervals isolated from one another by isolation devices deployed in spaced-apart relation to each other within an annulus defined between the tubing string and the wellbore, and where a valve assembly having at least a first valve and a second valve operable between an open configuration and a closed configuration is installed in multiple wellbore intervals, the method comprising:

determining at least one operational parameter comprising at least one property of an injection fluid, or at least one characteristic of the wellbore intervals, or a combination thereof;

based on the at least one determined operational parameter, for each wellbore interval, selectively operating the first valve and the second valve in the open or closed configuration to provide a selected openness for each valve assembly in the corresponding wellbore interval;

injecting at least one injection fluid down the tubing string so as to pass through at least one of the first valve and the second valve to enter a surrounding reservoir at corresponding wellbore intervals and promote recovery of oil via at least one adjacent production well.

3. The method of claim 2, wherein the open configuration is adapted to establish fluid communication between the tubing string and the surrounding reservoir via respective fluid passages, and the closed configuration is adapted to prevent fluid flow into the surrounding reservoir, and wherein the fluid passage of at least one of the first and the second valves is elongated and configured such that the open configuration of the corresponding valve is a choked configuration where fluid flowrate from the tubing string into the surrounding reservoir is restricted.

4. The method of claim 2, further comprising, after injecting the at least one injection fluid for a period of time, adjusting the configuration of at least one of the first valve and the second valve in at least one wellbore interval to change the selected openness thereof based on at least one of a change in a previously determined operational parameter and a further determined operational parameter.

5. The method of claim 4, wherein the change in the determined operational parameter comprises an increase in injectivity, and the change to the selected openness comprises reducing the openness to increase the resistance to flow via the valve assembly.

6. The method of claim 4, wherein the change in the determined operational parameter comprises modifying a type or a property of the injection fluid.

7. The method of claim 2, wherein the first and second valves are preconfigured to provide redundancy where at least two different configurations of the valve assembly provides a substantially similar overall openness for fluid flow through the fluid passages.

8. The method of claim 2, wherein the first and second valves are preconfigured to provide a range of overall openness for fluid flow through the fluid passages at the different configurations of the valve assembly, the range comprising evenly distributed flow resistances from minimum to maximum fluid flow.

9. The method of claim 2, wherein fluid communication between adjacent valves along the same wellbore interval is established along the annulus, in the surrounding reservoir, or a combination thereof.

10. The method of claim 2, wherein a single injection fluid is injected over time or different injection fluids are alternated over time.

11. The method of claim 10, wherein the injection fluid is water and the method is operated as a water flooding operation.

12. A method for oil recovery from an existing well in which a tubing string is installed, the well having a plurality of wellbore intervals isolated from one another by isolation devices deployed in spaced-apart relation to each other within an annulus defined between the tubing string and a wellbore, and where a valve assembly having at least a first valve and a second valve respectively operable between an open configuration and a closed configuration is installed in multiple wellbore intervals, the method comprising:

determining at least one operational parameter comprising at least one property of a fluid, or at least one characteristic of the wellbore intervals, or a combination thereof;

comparing the at least one determined operational parameter with at least one desired operational parameter to define a valve openness, based on the at least one determined operational parameter and the at least one desired operational parameter, for each wellbore interval, selectively operating each one of the first and the second valves between the open and the closed configurations to provide the valve openness for each valve assembly in the corresponding wellbore interval;

operating the well to have fluid pass through at least one of the first valve and the second valve between a surrounding reservoir and the tubing string at corresponding wellbore intervals and promote oil recovery.

13. The method of claim 12, wherein operating the well comprises injecting at least one injection fluid down the tubing string to pass through at least one of the first valve and the second valve to enter the surrounding reservoir from the tubing string to promote oil recovery via at least one adjacent production well.

14. The method of claim 12, wherein operating the well comprises recovering production fluid components that pass through at least one of the first valve and the second valve to enter the tubing string from the surrounding reservoir to form a combined production fluid within the tubing string.

15. The method of claim 14, further comprising the step of producing the combined production fluid to surface via the tubing string.

16. The method of claim 12, wherein the first and second valves of the multivalve interval each comprise a corresponding valve housing provided with a valve sleeve slidably mounted therein and being shiftable to different positions to provide the open and closed configurations.

17. The method of claim 16, wherein each valve sleeve is operable in a central position, an uphole position and a downhole position, the position of the valve sleeves within their respective valve housings corresponding to an operational configuration of the corresponding valve.

18. The method of claim 16, wherein the change of the selected openness of each valve assembly is performed by shifting the sleeve of at least one of the first and second valves.

19. The method of claim 12, wherein operating the well comprises a cyclic process alternating between injecting injection fluid through at least one of the first valve and the second valve, and recovering production fluid components that pass through at least one of the first valve and the second valve to enter the tubing string from the surrounding reservoir to form a combined production fluid within the tubing string for production to surface.

20. The method of claim 12, wherein operating the well comprises a cyclic process alternating between injecting injection fluid through at least one valve assembly, and recovering production fluid components via at least one valve assembly to enter the tubing string from the surrounding reservoir to form a combined production fluid within the tubing string for production to surface.

* * * * *